United States Patent [19]

Saitoh et al.

[11] Patent Number: 4,696,884

[45] Date of Patent: Sep. 29, 1987

[54] MEMBER HAVING PHOTOSENSITIVE LAYER WITH SERIES OF SMOOTHLY CONTINUOUS NON-PARALLEL INTERFACES

[75] Inventors: Keishi Saitoh, Ibaraki; Masahiro Kanai, Tokyo; Tetsuo Sueda, Chofu; Teruo Misumi, Kawasaki; Yoshio Tsuezuki, Toride; Kyosuke Ogawa, Tokyo, all of Japan

[73] Assignee: Canon Kabushiki Kaisha, Tokyo, Japan

[21] Appl. No.: 705,516

[22] Filed: Feb. 26, 1985

[30] Foreign Application Priority Data

| | | | |
|---|---|---|---|
| Feb. 27, 1984 | [JP] | Japan | 59-35700 |
| Feb. 28, 1984 | [JP] | Japan | 59-36903 |
| Mar. 6, 1984 | [JP] | Japan | 59-43495 |

[51] Int. Cl.[4] ..... G03G 5/085

[52] U.S. Cl. ..... 430/58; 430/65; 430/69; 430/133

[58] Field of Search ..... 430/67, 69, 56, 127, 430/55, 133, 134, 58, 65

[56] References Cited

U.S. PATENT DOCUMENTS

| | | | |
|---|---|---|---|
| 4,359,514 | 11/1982 | Shimizu et al. | 430/65 |
| 4,492,745 | 1/1985 | Mimura et al. | 430/67 |
| 4,514,483 | 4/1985 | Matsuura et al. | 430/84 |

*Primary Examiner*—John L. Goodrow

*Attorney, Agent, or Firm*—Fitzpatrick, Cella, Harper & Scinto

[57] ABSTRACT

A light-receiving member comprises a light-receiving layer of a multi-layer structure having at least one photosensitive layer on a substrate, said photosensitive layer having at least one pair of non-parallel interfaces within a short range and said non-parallel interfaces being arranged in a large number in at least one direction within the plane perpendicular to the layer thickness direction, each of said non-parallel interfaces being smoothly continuous in the direction in which they are arranged.

46 Claims, 33 Drawing Figures

MEMBER HAVING PHOTOSENSITIVE LAYER WITH SERIES OF SMOOTHLY CONTINUOUS NON-PARALLEL INTERFACES

BACKGROUND OF THE INVENTION

1. Field of the Invention

This invention relates to a light-receiving member having sensitivity to electromagnetic waves such as light [herein used in a broad sense, including ultraviolet rays, visible light, infrared rays, X-rays and gamma-rays]. More particularly, it partains to a light-receiving member suitable for using coherent light such as laser beam.

2. Description of the Prior Art

As the method for recording a digital image information as an image, there have been well known the methods in which an electrostatic latent image is formed by scanning optically a light-receiving member with a laser beam modulated corresponding to a digital image information, then said latent image is developed, followed by processing such as transfer or fixing, if desired, to record an image. Among them, in the image forming method employing electrophotography, image recording has been generally practiced with the use of a small size and inexpensive He-Ne laser or a semiconductor laser (generally having an emitted wavelength of 650–820 nm).

In particular, as the light-receiving member having a photosensitive layer for electrophotography which is suitable when using a semiconductor laser, an amorphous material containing silicon atoms (hereinafter written briefly as "A—Si") as disclosed in Japanese Laid-open Patent Application Nos. 86341/979 and 83746/1981 is attracting attention for its high Vickers hardness and non-polluting properties in social aspect in addition to the advantage of being by far superior in matching in its photosensitive region as compared with other kinds of light-receiving members.

However, when the photosensitive layer is made of a single A—Si layer, for ensuring dark resistance of $10^{12}$ ohm.cm or higher required for electrophotography while maintaining high photosensitivity, it is necessary to incorporate structurally hydrogen atoms or halogen atoms, or boron atoms in addition thereto in controlled form within specific ranges of amounts. Accordingly, control of layer formation is required to be performed severely, whereby tolerance in designing of a light-receiving member is considerably limited.

As attempts to enlarge this tolerance in designing, namely to enable effective utilization of its high photosensitivity in spite of somewhat lower dark resistance, there have been proposed a light-receiving layer with a multi-layer structure of two or more laminated layers with different conductivity characteristics with formation of a depletion layer within the light-receiving layer, as disclosed in Japanese Laid-open Patent Application Nos. 121743/1979, 4053/1982 and 4172/1982, or a light-receiving member with a multi-layer structure in which a barrier layer is provided between the substrate and the photosensitive layer and/or on the upper surface of the photosensitive layer, thereby enhancing apparent dark resistance of the light-receiving layer as a whole, as disclosed in Japanese Laid-open Patent Application Nos. 52178/1982, 52179/1982, 52180/1982, 58159/1982, 58160/1982 and 58161/1982.

According to such proposals, A—Si type light-receiving members have been greatly advanced in tolerance in designing of commercialization thereof or easiness in management of its production and productivity, and the speed of development toward commercialization is now further accelerated.

When carrying out laser recording by use of such a light-receiving member having a light-receiving layer of a multi-layer structure, due to irregularity in thickness of respective layers, and also because of the laser beam which is a coherent monochromatic light, it is possible that the respective reflected lights reflected from the free surface on the laser irradiation side of the light-receiving layer and the layer interface between the respective layers constituting the light-receiving layer and between the substrate and the light-receiving layer (hereinafter "interface" is used to mean comprehensively both the free surface and the layer interface) may undergo interference.

Such an interference phenomenon results in the so called interference fringe pattern in the visible image formed and a cause a poor image. In particular, in the case of forming a medium tone image with high gradation, bad appearance of the image will become marked.

Moreover, as the wavelength region of the semiconductor laser beam is shifted toward longer wavelength, absorption of said laser beam in the photosensitive layer becomes reduced, whereby the above interference phenomenon becomes more marked.

This point is explained by referring to the drawings.

FIG. 1 shows a light $I_0$ entering a certain layer constituting the light-receiving layer of a light-receiving member, a reflected light $R_1$ from the upper interface 102 and a reflected light $R_2$ reflected from the lower interface 101.

Now, the average layer thickness of the layer is defined as d, its refractive index as n and the wavelength of the light as $\lambda$, and when the layer thickness of a certain layer is ununiform gently with a layer thickness difference of $\lambda/2n$ or more, changes in absorbed light quantity and transmitted light quantity occur depending on to which condition of $2nd=m\lambda$ (m is an integer, reflected lights are strengthened with each other) and $2nd=(m+\frac{1}{2})\lambda$ (m is an integer, reflected lights are weakened with each other) the reflected lights $R_1$ and $R_2$ conform.

In the light-receiving member of a multilayer structure, the interference effect as shown in FIG. 1 occurs at each layer, and there ensues a synergistic deleterious influence through respective interferences as shown in FIG. 2. For this reason, the interference fringe corresponding to said interference fringe pattern appears on the visible image transferred and fixed on the transfer member to cause bad images.

As the method for cancelling such an inconvenience, it has been proposed to subject the surface of the substrate to diamond cutting to provide unevenness of ±500Å–±10000Å, thereby forming a light scattering surface (as disclosed in Japanese Laid-open Patent Application No. 162975/1983); to provide a light absorbing layer by subjecting the aluminum substrate surface to black Alumite treatment or dispersing carbon, color pigment or dye in a resin (as disclosed in Japanese Laid-open Patent Application No. 165845/1982); and to provide a light scattering reflection preventive layer on the substrate surface by subjecting the aluminum substrate surface to satin-like Alumite treatment or by providing a sandy fine unevenness by sand blast (as disclosed in Japanese Laid-open Patent Application No. 16554/1982).

However, according to these methods of the prior art, the interference fringe pattern appearing on the image could not completely be cancelled.

For example, because only a large number of unevenness with specific sizes are formed on the substrate surface according to the first method, although prevention of appearance of interference fringe through light scattering is indeed effected, regular reflection light component yet exists. Therefore, in addition to remaining of the interference fringe by said regular reflection light, enlargement of irradiated spot occurs (the so called blurring phenomenon) due to the light scattering effect on the surface of the substrate to be a cause for substantial lowering of resolution.

As for the second method, such a black Alumite treatment is not sufficient for complete absorption, but reflected light from the substrate surface remains. Also, there are involved various inconveniences. For example, in providing a resin layer containing a color pigment dispersed therein, a phenomenon of degrassihg from the resin layer occurs during formation of the A—Si photosensitive layer to markedly lower the layer quality of the photosensitive layer formed, and the resin layer suffers from a damage by the plasma during formation of A—Si photosensitive layer to be deteriorated in its inherent absorbing function. Besides, worsening of the surface state deleteriously affects subsequent formation of the A—Si photosensitive layer.

In the case of the third method of irregularly roughening the substrate surface, as shown in FIG. 3, for example, the incident light $I_0$ is partly reflected from the surface of the light-receiving layer 302 to become a reflected light $R_1$, with the remainder progressing internally through the light-receiving layer 302 to become a transmitted light $I_1$. The transmitted light $I_1$ is partly scattered on the surface of the substrate 301 to become scattered lights $K_1$, $K_2$, $K_3$. . . $K_n$, with the remainder being regularly reflected to become a reflected light $R_2$, a part of which goes outside as an emitted light $R_3$. Thus, since the reflected light $R_1$ and the emitted light $R_3$ which is an interferable component remain, it is not yet possible to extinguish completely the interference fringe pattern.

On the other hand, if diffusibility of the surface of the substrate 301 is increased in order to prevent multiple reflections within the light-receiving layer 302 through prevention of interference, light will be diffused within the light-receiving layer 302 to cause halation, whereby resolution is disadvantageously lowered.

Particularly, in a light-receiving member of a multilayer structure, as shown in FIG. 4, even if the surface of the substrate 401 may be irregularly roughened, the reflected light $R_2$ from the surface of the first layer 402, the reflected light $R_1$ from the surface of the second layer 403 and the regularly reflected light $R_3$ from the surface of the substrate 401 are interfered with each other to form an interference fringe pattern depending on the respective layer thicknesses of the light-receiving member. Accordingly, in a light-receiving member of a multilayer structure, it was impossible to completely prevent appearance of interference fringes by irregularly roughening the surface of the substrate 401.

In the case of roughening irregularly the substrate surface according to the method such as sand blasting, etc., the roughening degree will vary so much from lot to lot, and there is also ununiformness in roughening degree even in the same lot, and therefore production management could be done with inconvenience. In addition, there were so many chances where relatively large projections with random distribution are frequently formed, hence causing locally electrical breakdown of the light-receiving layer during charging treatment.

On the other hand, in the case of simply roughening the surface of the substrate 501 regularly, as shown in FIG. 5, since the light-receiving layer 502 is deposited along the uneven shape of the surface of the substrate 501, the slated plane 503 of the unevenness of the substrate 501 becomes parallel to the slated plane 504 of the unevenness of the light-receiving layer 502.

Accordingly, for the incident light on that portion, $2nd_1=m\lambda$ or $2nd_1=(m+\frac{1}{2})\lambda$ holds, to make it a light portion or a dark portion. Also, in the light-receiving layer as a whole, since there is nonuniformity in which the maximum difference among the layer thicknesses $d_1$, $d_2$, $d_3$ and $d_4$ of the light-receiving layer is $\lambda/2n$ or more, there appears a light and dark fringe pattern.

Thus, it is impossible to completely extinguish the interference fringe pattern by only roughening regularly the surface of the substrate 501.

Also, in the case of depositing a light-receiving layer of a multi-layer structure on the substrate the surface of which is regularly roughened, in addition to the interference between the regularly reflected light from the substrate surface and the reflected light from the light-receiving layer surface as explained for light-receiving member for a single layer structure in FIG. 3, interferences by the reflected lights from the interfaces between the respective layers participate to make the extent of appearance of interference fringe pattern more complicated than in the case of the light-receiving member of a single layer structure.

The problems as discussed above can also occur in a light-receiving member for an organic semiconductor type electrophotography having a laminated structure of a charge transport layer and a charge generation layer containing a phthalocyanine pigment such as copper phthalocyanine, aluminum chloride phthalocyanine, etc. or a light-receiving member for electrophotography of a multi-layer constitution of chalocogen type employing selenium-tellurium or arsenic selenide, and it is necessary to overcome these problems similarly as in the case of A-Si type light-receiving member.

SUMMARY OF THE INVENTION

An object of the present invention is to provide a novel light-receiving member sensitive to light, which has cancelled the drawbacks as described above.

Another object of the present invention is to provide a light-receiving member which is suitable for image formation by use of coherent monochromatic light and also easy in production control.

Still another object of the present invention is to provide a light-receiving member which can completely cancel both of the interference fringe pattern appearing during image formation and appearance of speckles on reversal developing.

According to the present invention, there is provided a light-receiving member comprising a light-receiving layer of a multi-layer structure having at least one photosensitive layer on a substrate, said photosensitive layer having at least one pair of non-parallel interfaces within a short range and said non-parallel interfaces being arranged in a large number in at least one direction within the plane perpendicular to the layer thickness direction, each of said non-parallel interfaces being smoothly continuous in the direction in which they are arranged.

DESCRIPTION OF THE PREFERRED EMBODIMENTS

Referring now to the accompanying drawings, the present invention is to be described in detail.

FIGS. 6A–6D is a schematic illustration for explanation of the basic principle of the present invention.

In the present invention, on a substrate (not shown) having a smooth uneven shape which is smaller than the resolution required for the device along slanted plane of the unevenness, a light-receiving layer of a multi-layer constitution having at least one photosensitive layer is shown enlarged in a part of FIG. 6. As shown in FIG. 6, since the thickness of the second layer 602 is continuously changed from $d_5$ to $d_6$, the interface 603 and the interface 604 have respective gradients. Accordingly, the coherent light incident on this minute portion (short range region) l [indicated schematically by arrowhead in FIG. 6(C), and its enlarged view is shown in FIG. 6(A)] undergoes interference at said munite portion l to form a minute interference fringe pattern.

Figure 1:
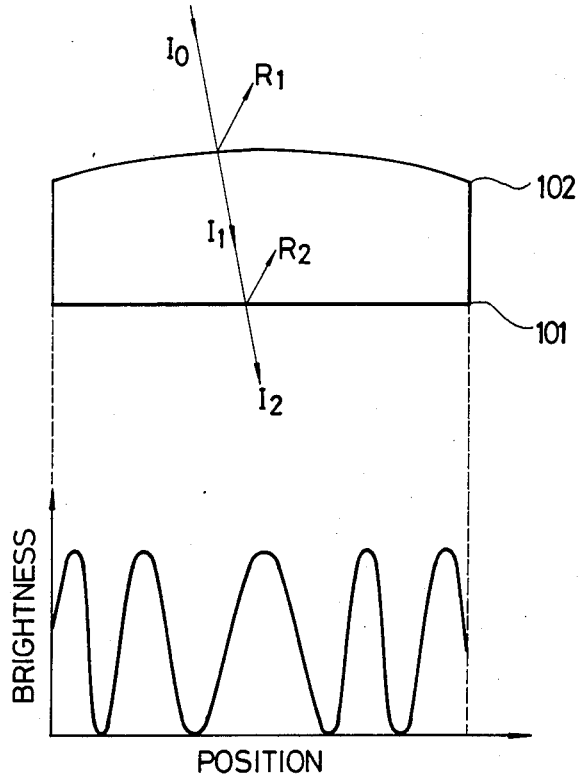
FIG. 1 is a schematic illustration of interference fringe in general.
Figure 2:
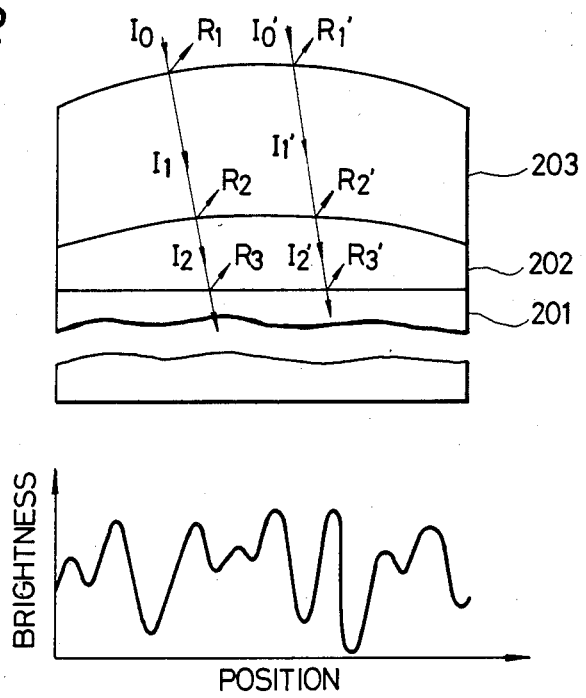
FIG. 2 is a schematic illustration for explaining appearance of interference fringe in the case of a multi-layer light-receiving member.
Figure 3:
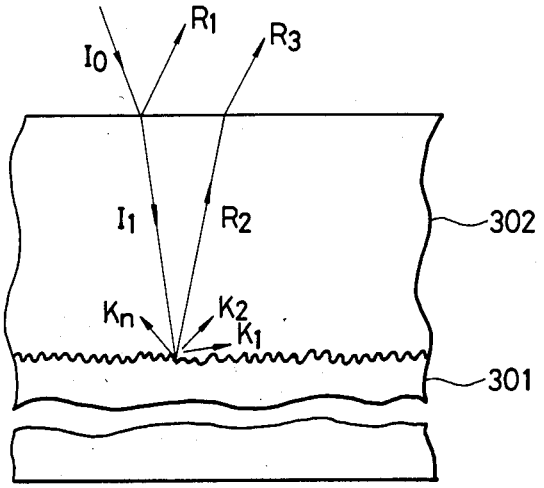
FIG. 3 is a schematic illustration for explaining appearance of interference fringe by scattered light.
Figure 4:
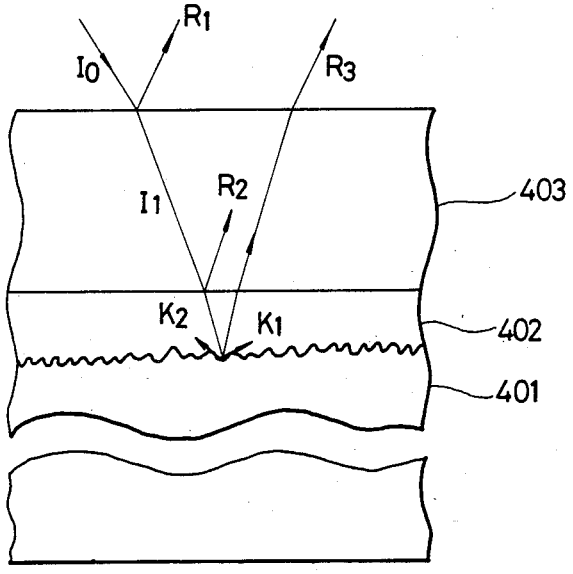
FIG. 4 is a schematic illustration for explaining appearance of interference fringe by scattered light in the case of a multi-layer light-receiving member.
Figure 5:
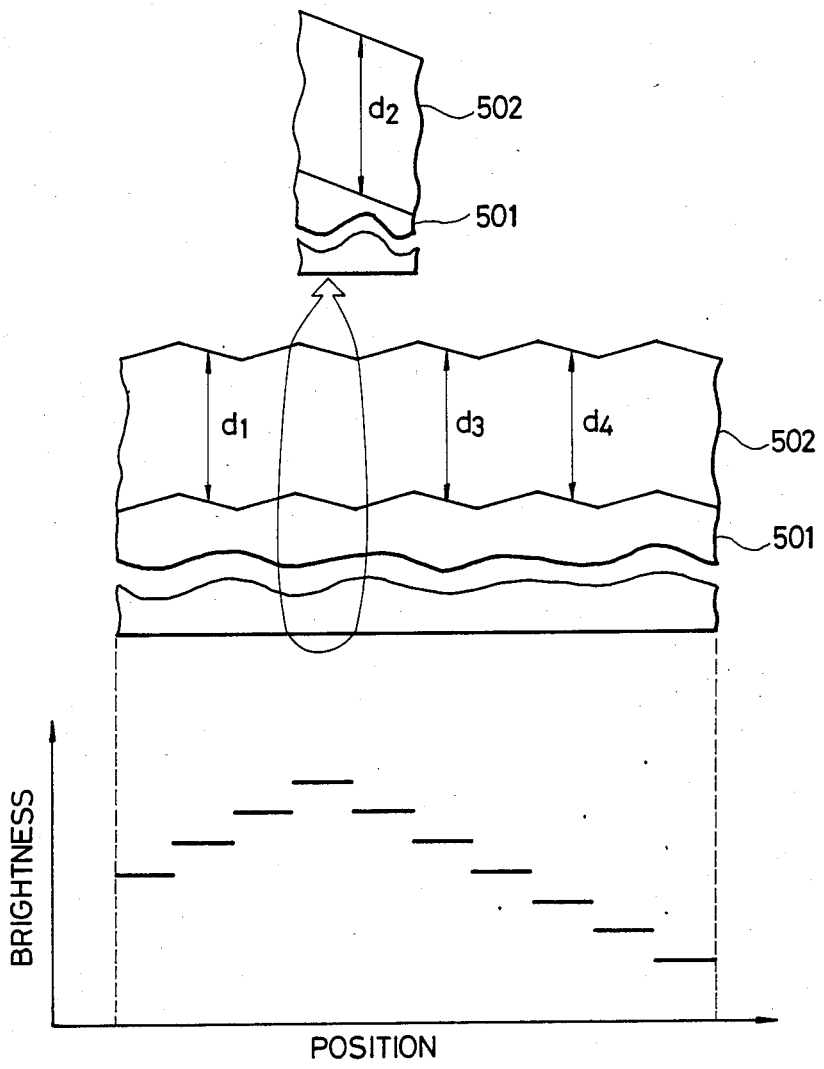
FIG. 5 is a schematic illustration of interference fringe in the case where the interfaces of respective layers of a light-receiving member are parallel to each other.
Figure 6A:
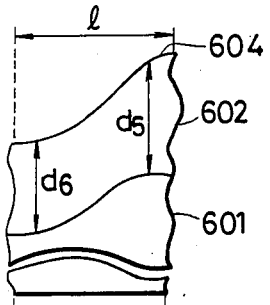
FIGS. 6A–6D is a schematic illustration for explaining the principle about no appearance of interference fringe in the case of non-parallel interfaces between respective layers of a light-receiving member.
Figure 6B:
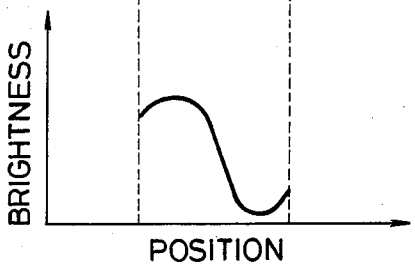
Figure 6C:
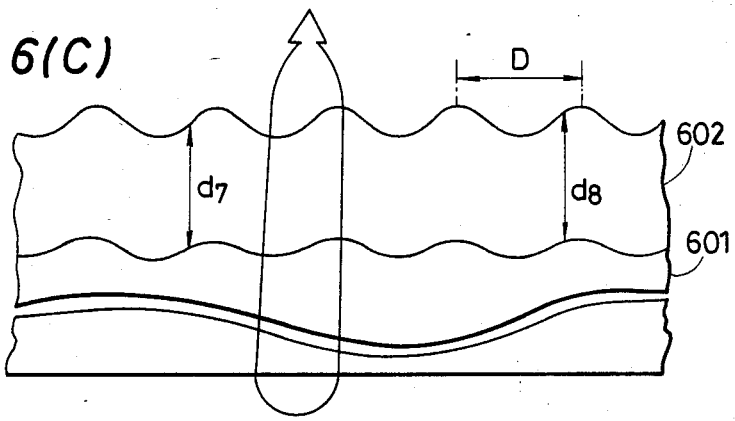
Figure 6D:
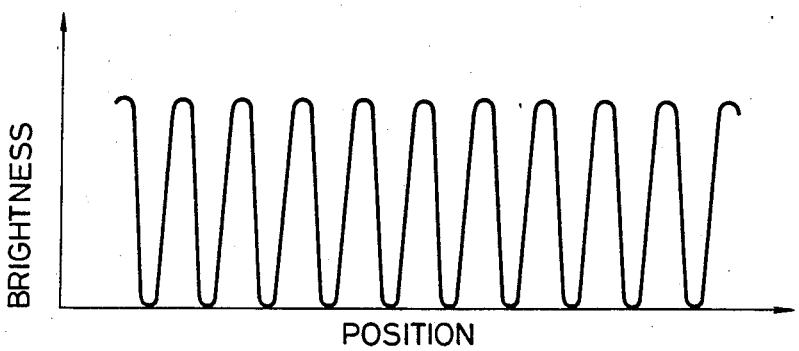
Figure 7A:
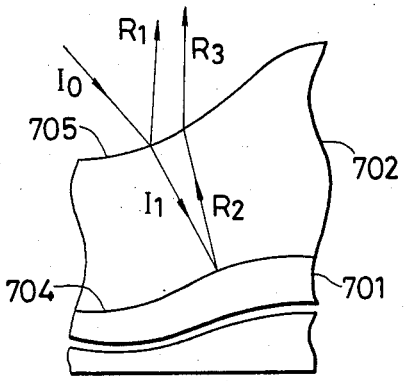
FIGS. 7A–7C is a schematic illustration of comparison of the reflected light intensity between the case of parallel interfaces and non-parallel interfaces between the respective layers of a light-receiving member.
Figure 7B:
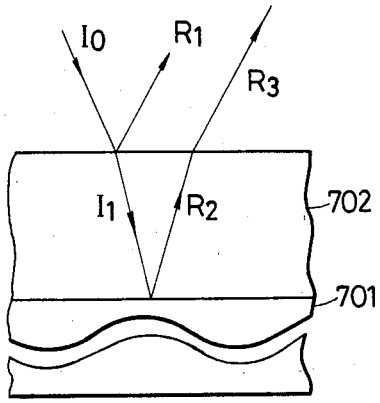
Figure 7C:
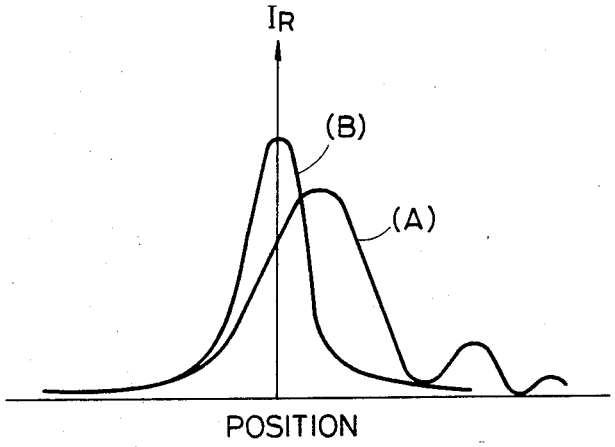

Also, as shown in FIG. 7, when the interface 704 between the first layer 701 and the second layer 702 and the free surface 705 are non-parallel to each other, the reflected light $R_1$ and the emitted light $R_3$ for the incident light $I_0$ are different in direction of propagation from each other as shown in FIG. 7 (A), and therefore the degree of interference will be reduced as compared with the case when the interface 704 and free surface 705 are parallel to each other (FIG. 7 (B)).

Accordingly, as shown in FIG. 7 (C), as compared with the case "(B)", where a pair of the interfaces are in parallel relation, the difference in contrast of the interference fringe pattern becomes negligibly small even if interfered, in the non-parallel case "(A)". As the result, the quantity of light entering the minute portion will become levelled.

The same is the case, as shown in FIG. 6, even when the layer thickness of the layer 602 may be macroscopically nonuniform ($d_7 \neq d_8$), and therefore the incident light quantity becomes uniform all over the layer region (see FIG. 6 (D)).

Figure 8:
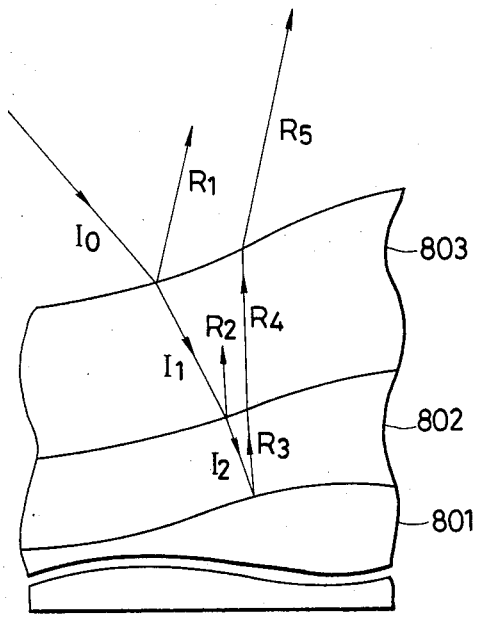
FIG. 8 is a schematic illustration for explaining no appearance of interfernece fringe in the case of non-parallel interfaces between respective layers as developed in the case of two layers.

To describe about the effect of the present invention at the time when coherent light is transmitted from the irradiated side to the second layer in the case of a light-receiving layer of a multilayer structure, reflected lights $R_1$, $R_2$, $R_3$, $R_4$ and $R_5$ are produced for the incident light $I_0$, as shown in FIG. 8. Accordingly, at the respective layers, the same effect as described with reference to FIG. 7 occurs.

Therefore, when considered for the light-receiving layer as a whole, interference occurs as a synergetic effect of the respective layers and, according to the present invention, appearance of interference can further be prevented as the number of layers constituting the light-receiving layer is increased.

The interference fringe produced within the minute portion cannot appear on the image, because the size of the minute portion is smaller than the spot size of the irradiated light, namely smaller than the resolution limit. Further, even if appeared on the image, there is no problem at all, since it is less than resolving ability of the eyes.

In the present invention, the slanted plane of unevenness should desirably be mirror finished in order to direct the reflected light assuredly in one direction.

The size l (one cycle of uneven shape) of the minute portion suitable for the present invention may be preferably $l < L$, wherein L is the spot size of the incident light.

By way of such a design, the diffraction effect can be more positively utilized to inhibit more effectively the appearance of interference fringe.

Further, in order to accomplish more effectively the objects of the present invention, the layer thickness difference ($d_5 - d_6$) at the minute portion l should desirably be as follows (see FIG. 6):

$$d_5 - d_6 \geqq \lambda / 2n_1$$

(where $\lambda$ is the wavelength of the incident light and $n_1$ is the refractive index of the second layer 602).

In the present invention, within the layer thickness of the minute portion l (hereinafter called as "minute column") in the light-receiving layer of a multi-layer structure, the layer thicknesses of the respective layers are controlled so that at least two layer interfaces may be in non-parallel relationship, and, provided that this condition is satisfied, any two layer interfaces may be in parallel relationship within said minute column.

However, it is desirable that the layers forming parallel interfaces should be formed to have uniform layer thicknesses so that the difference in layer thickness at any two positions may be not more than:

$\lambda/2n_2$($n_2$: refractive index of the layer concerned).

For formation of the respective layers such as photosensitive layer, charge injection preventive layer, barrier layer comprising an electrically insulating material which are selected as one of the layers constituting the multi-layer light-receiving layer of the light-receiving member of the present invention, in order to accomplish more effectively and easily the objects of the present invention, the plasma chemical vapor deposition method (PCVD method), the optical CVD method and thermal CVD method can be employed, because the layer thickness can accurately be controlled on the optical level thereby.

The smooth unevenness to be provided on the substrate surface, in the case of a substrate such as metals which can be subjected to mechanical working, can be formed by fixing a bite having a circular arc shaped cutting blade at a predetermined position on a cutting working machine such as milling machine, lathe, etc. and by cut working accurately the substrate surface by, for example, moving regularly in a certain direction while rotating a cylindrical substrate according to a program previously designed as desired, thereby forming a desired smooth unevenness shape, pitch and depth. The projection of the sine wave shape produced by the unevenness formed by such a cutting working has a spiral structure with the center axis of the cylindrical substrate as its center.

The spiral structure of the projection of the sine wave shape may be made into a multiple spiral structure such as double or triple structure or a crossed spiral structure.

Alternatively, a straight line structure along the center axis may also be introduced in addition to the spiral structure.

In the present invention, the respective dimensions of the unevenness provided on the substrate surface under the controlled condition are set so as to accomplish consequently the objects of the present invention in view of the above points.

More specifically, in the first place, the A—Si layer constituting the photosensitive layer is sensitive to the structure of the surface on which the layer is formed, and the layer quality will be changed greatly depending on the surface condition.

Accordingly, it is necessary to set dimensions of the smooth unevenness to be provided on the substrate surface so that lowering in layer quality of the A—Si photosensitive layer may not be brought about.

Secondly, when there is an extreme unevenness on the free surface of the light-receiving layer, cleaning cannot completely be performed after image formation.

Further, in case of practicing blade cleaning, there is involved the problem that the blade will be damanged more easily.

As the result of investigations of the problems in layer deposition as described above, problems in process of electrophotography and the conditions for prevention of interference fringe pattern, it has been found that the pitch at the recessed portion on the substrate surface may preferably be 0.3 μm to 500 μm, more preferably 1 to 200 μm, most preferably 5 μm to 50 μm.

It is also desirable that the maximum depth of the smooth recessed portion may preferably be made 0.1 μm to 5 μm, more preferably 0.3 μm to 3 μm, most preferably 0.6 μm to 2 μm.

When the pitch and the maximum depth of the recessed portions on the substrate surface are within the ranges as specified above, the gradient of the slanted plane connecting the minimum value point and the maximum value point, respectively, of the adjacent recessed portion and convex portion may preferably be 1° to 20°, more preferably 3° to 15°, most preferably 4° to 10°.

On the other hand, the maximum of the layer thickness based on such nonuniformity in layer thickness of the respective layers formed on such a substrate may preferably be made 0.1 μm to 2 μm within the same pitch, more preferably 0.1 μm to 1.5 μm, most preferably 0.2 μm to 1 μm.

Referring now to a preferred embodiment, the light-receiving member of the present invention having a multi-layer constitution is to be described.

Figure 9:
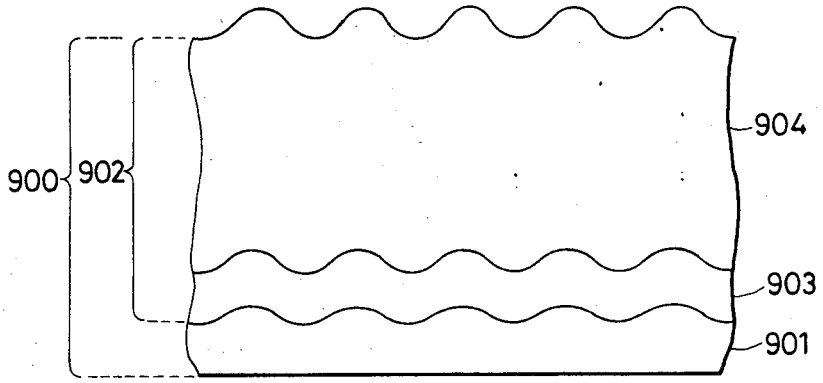
FIG. 9 and FIG. 24 are each a schematic illustration of a light-receiving member.

The light-receiving member 900 shown in FIG. 9 has a light-receiving layer 902 on a substrate 901 which is subjected to surface cutting working so as to achieve the object of the invention, said light-receiving layer 902 being constituted of a charge injection preventive layer 903 and a photosensitive layer 904 from the side of the substrate 901.

The substrate 901 may be either electrically conductive or insulating. As the electroconductive substrate, there may be mentioned metals such as NiCr, stainless steel, Al, Cr, Mo, Au, Nb, Ta, V, Ti, Pt, Pd etc. or alloys thereof.

As insulating substrates, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. The surface thereof is preferably subjected to the treatment for electric conduction, and it is desirable to provide other layers on the surface subjected to the treatment for electric conduction.

For example, the treatment for electric conduction of a glass can be effected by providing a thin film of NiCr, Al, Cr, Mo, Au, Ir, Nb, Ta, V, Ti, Pt, Pd, $In_2O_3$,$SnO_2$, ITO ($In_2O_3+SnO_2$) thereon. Alternatively, a synthetic resin film such as polyester film can be subjected for electric conduction of its surface by vacuum vapor deposition, electron-beam deposition or sputtering of a metal such as NiCr, Al, Ag, Pd, Zn, Ni, Au, Cr, Mo, Ir, Nb, Ta, V, Ti, Pt, etc. or by laminating treatment with said metal, thereby imparting electroconductivity to the surface. The substrate may be shaped in any form such as cylinders, belts, plates or others, and its form may be determined as desired. For example, when the light-receiving member 900 in FIG. 9 is to be used as an image forming member for electrophotography, it may desirably be formed into an endless belt or a cylinder for use in continuous high speed copying. The substrate may have a thickness, which is conveniently determined so that a light-receiving member as desired may be formed. When the light-receiving member is required to have a flexibility, the substrate is made as thin as possible, so far as the function of a substrate can be exhibited.

However, in such a case, the thickness is generally 10μ or more from the points of fabrication and handling of the substrate as well as its mechanical strength.

The charge injection preventive layer 903 is provided for the purpose of preventing injection of charges from the substrate 901 side into the photosensitive layer, thereby increasing apparent resistance.

The charge injection preventive layer 903 is constituted of A—Si containing hydrogen atoms and/or halogen atoms (X) (hereinafter written as "A—Si(H,X)") and also contains a substance (C) for controlling conductivity. As the substance (C) for controlling conductivity, there may be mentioned so called impurities in the field of semiconductors. In the present invention, there may be included p-type impurities giving p-type conductivity characteristics and n-type impurities giving n-type conductivity characteristics to Si. More specifically, there may be mentioned as p-type impurities atoms belonging to the group III of the periodic table (Group III atoms), such as B (boron), Al (aluminum), Ga (gallium), In (indium), tl (thallium), etc., particularly preferably B and Ga.

As n-type impurities, there may be included the atoms belonging to the group V of the periodic table (Group V atoms), such as P (phosphorus), As (arsenic), Sb (antimony), Bi (bismuth), etc., particularly preferably P and As.

In the present invention, the content of the substance (C) for controlling conductivity contained in the charge injection preventing layer 903 may be suitably be determined depending on the charge injection preventing characteristic required, or on the organic relationship such as relation with the characteristic at the contacted interface with said substrate 901 when said charge injection preventive layer 903 is provided on the substrate 901 in direct contact therewith. Also, the content of the substance (C) for controlling conductivity is determined suitably with due considerations of the relationships with characteristics of other layer regions provided in direct contact with the above charge injection preventive layer or the characteristics at the contacted interface with said other layer regions.

In the present invention, the content of the substance (C) for controlling conductivity contained in the charge injection preventive layer 903 may preferably be 0.001 to $5\times10^4$ atomic ppm, more preferably 0.5 to $1\times10^4$ atomic ppm, most preferably 1 to $5\times10^3$ atomic ppm.

In the present invention, by making the content of the substance (C) in the charge injection preventive layer 903 preferably 30 atomic ppm or more, more preferably 50 atomic ppm or more, most preferably 100 atomic ppm or more, for example, in the case when said substance (C) to be incorporated is a p-type impurity mentioned above, migration of electrons injected from the substrate 901 side into the photosensitive layer 904 can be effectively inhibited when the free surface of the light-receiving layer 902 is subjected to the charging treatment to ⊕ polarity. On the other hand, when the substance (C) to be incorporated is a n-type impurity as mentioned above, migration of positive holes injected from the substrate 901 side into the photosensitive layer 904 can be more effectively ihibited when the free surface of the light-receiving layer 902 is subjected to the charging treatment to ⊖ polarity.

The charge injection preventive layer 903 may have a thickness preferably of 30Å to 10μ, more preferably of 40Å to 8μ, most preferably of 50Å to 5μ.

The photosensitive layer 904 is constituted of A—Si(H,X) and has both the generation function to generate photocarriers by irradiation with a laser beam and the charge transport function to transport said charges.

The photosensitive layer 904 may have a thickness preferably of 1 to 100μ, more preferably of 1 to 80μ, most preferably of 2 to 50μ.

The photosensitive layer 904 may contain a substance for controlling conductivity of the other polarity than that of the substance for controlling conductivity contained in the charge injection preventive layer 903, or a substance for controlling conductivity of the same polarity may be contained therein in an amount by far smaller than that practically contained in the charge injection preventive layer 903.

In such a case, the content of the substance for controlling conductivity contained in the above photosensitive layer 904 can be determined adequately as desired depending on the polarity or the content of the substance contained in the charge injection preventive layer 903, but it is preferably 0.001 to 1000 atomic ppm, more preferably 0.05 to 500 atomic ppm, most preferably 0.1 to 200 atomic ppm.

In the present invention, when the same kind of a substance for controlling conductivity is contained in the charge injection preventive layer 903 and the photosensitive layer 904, the content of the substance in the photosensitive layer 904 should preferably be 30 atomic ppm or less.

In the present invention, the amount of hydrogen atoms (H) or the amount of halogen atoms (X) or the sum of the amounts of hydrogen atoms and halogen atoms (H+X) to be contained in the charge injection preventive layer 903 and the photosensitive layer 904 may preferably be 1 to 40 atomic %, more preferably 5 to 30 atomic %.

As halogen atoms (X), F, Cl, Br and I may be included and among them, F and Cl may preferably be employed.

In the light-receiving member shown in FIG. 9, a so called barrier layer comprising an electrically insulating material may be provided in place of the charge injection preventive layer 903. Alternatively, it is also possible to use said barrier layer in combination with the charge injection preventive layer 903.

As the material for forming the barrier layer, there may be included inorganic insulating materials such as $Al_2O_3$, $SiO_2$, $Si_3N_4$, etc. or organic insulating materials such as polycarbonate, etc.

In the light-receiving member of the present invention, for the purpose of making higher photosensitivity and dark resistance, and further for the purpose of improving adhesion between the substrate and the light-receiving layer, at least one kind of atoms selected from oxygen atoms, carbon atoms and nitrogen atoms are contained. Such atoms (OCN) to be contained in the light-receiving layer may be contained therein throughout the whole layer region or localized by being contained in a part of the layer region of the light-receiving layer.

The distribution state of oxygen atoms within the layer region containing oxygen atoms may be such that the distribution concentration C (OCN) may be either uniform or ununiform in the layer thickness direction of the light-receiving layer, but it may desirably be uniform within the plane parallel to the surface of the substrate.

In the present invention, the layer region (OCN) to be provided in the light-receiving layer in which atoms (OCN) are contained is provided so as to occupy the whole layer region of the light-receiving layer when it is primarily intended to improve photosensitivity and dark resistance, while it is provided so as to occupy the end portion layer region on the substrate side of the light-receiving layer when it is primarily intended to strengthen adhesion between the substrate and the light-receiving layer.

In the former case, the content of atoms (OCN) contained in the layer region (OCN) may desirably be made relatively smaller in order to maintain high photosensitivity, while in the latter case relatively larger in order to ensure reinforcement of adhesion to the substrate.

In the present invention, the content of the atoms (OCN) to be contained in the layer region (OCN) provided in the light-receiving layer can be selected suitably in organic relationship with the characteristics required for the layer region (OCN) itself, or with the characteristic at the contacted interface with the substrate when the said layer region (OCN) is provided in direct contact with the substrate, etc.

When other layer regions are to be provided in direct contact with the layer region (OCN), the content of the atoms (OCN) may suitably be selected with due considerations about the characteristics of said other layer regions or the characteristics at the contacted interface with said other layer regions.

The amount of the atoms (OCN) contained in the layer region (OCN) may be determined as desired depending on the characteristics required for the light-receiving member to be formed, but it may preferably be 0.001 to 50 atomic %, more preferably 0.002 to 40 atomic %, most preferably 0.003 to 30 atomic %.

In the present invention, when the layer region (OCN) occupies the whole region of the light-receiving layer or, although not occupying the whole region, the proportion of the layer thickness $T_O$ of the layer region (OCN) occupied in the layer thickness T of the light-receiving layer is sufficiently large, the upper limit of the content of the atoms (OCN) contained in the layer region (OCN) should desirably be made sufficiently smaller than the value as specified above.

In the case of the present invention, when the proportion of the layer thickness $T_O$ of the layer region (OCN) occupied relative to the layer thickness T of the light-receiving layer is 2/5 or higher, the upper limit of the content of the atoms (OCN) contained in the layer region (OCN) may desirably be made 30 atomic % or less, more preferably 20 atomic % or less, most preferably 10 atomic % or less.

According to a preferred embodiment of the present invention, it is desirable that the atoms (OCN) should be contained in at least the above charge injection preventive layer and the barrier layer provided directly on the substrate. In short, by incorporating the atoms (OCN) at the end portion layer region on the substrate side in the light-receiving layer, it is possible to effect reinforcement of adhesion between the substrate and the light-receiving layer.

Further, in the case of nitrogen atoms, for example, under the co-presence of boron atoms, improvement of dark resistance and improvement of photosensitivity can further be ensured, and therefore they should preferably be contained in a desired amount in the photosensitive layer.

Plural kinds of these atoms (OCN) may also be contained in the light-receiving layer. For example, oxygen atoms may be contained in the charge injection preventive layer, nitrogen atoms in the photosensitive layer, or alternatively oxygen atoms and nitrogen atoms may be permitted to be co-present in the same layer region.

FIGS. 15 through 23 show typical examples of ununiform depth profiles in the layer thickness direction of the atoms (OCN) contained in the layer region (OCN) in the light-receiving member of the present invention.

In FIGS. 15 through 23, the abscissa indicates the distributed concentration C of the atoms (OCN), and the ordinate the layer thickness of the layer region (OCN), $t_B$ showing the position of the end face of the layer region (OCN) on the substrate side, while $t_T$ shows the position of the other end face of the layer region (OCN) opposite to the substrate side. Thus, layer formation of the layer region (OCN) containing the atoms (OCN) proceeds from the $t_B$ side toward the $t_T$ side.

Figure 15:
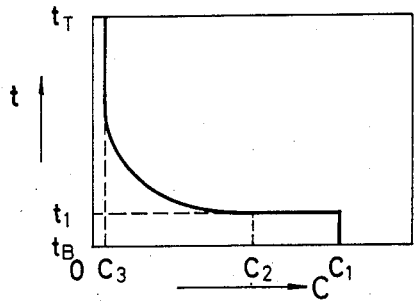
FIGS. 15 through 23 are each schematic illustration of the depth profile of the atoms (OCN) in the layer region (OCN)

FIG. 15 shows a first typical embodiment of the depth profile in the layer thickness direction of the atoms (OCN) contained in the layer region (OCN).

In the embodiment shown in FIG. 15, from the interface position $t_B$ where the surface on which the layer region (OCN) containing the atoms (OCN) is formed contacts the surface of said layer region (OCN) to the position of $t_1$, the atoms (OCN) are contained in the layer region (OCN) to be formed while the distribution concentration of the atoms (OCN) taking a constant value of $C_1$, said distribution concentration being gradually continuously reduced from $C_2$ from the position $t_1$ to the interface position $t_T$, until at the interface position $t_T$, the distribution concentration C is made $C_3$.

Figure 16:
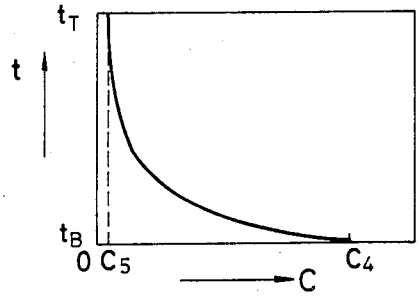

In the embodiment shown in FIG. 16, the distribution concentration C of the atoms (OCN) contained is reduced gradually continuously from the concentration $C_4$ from the position $t_B$ to the position $t_T$, at which it becomes the concentration $C_5$.

Figure 17:
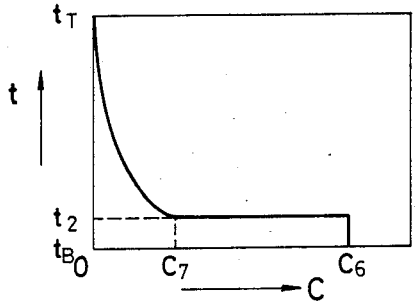

In the case of FIG. 17, from the position $t_B$ to the position $t_2$, the distribution concentration of the atoms (OCN) is made constantly at $C_6$, reduced gradually continuously between the position $t_2$ and the position $t_T$, until at the position $t_T$, the distribution concentration C is made substantially zero (herein substantially zero means the case of less than the detectable level).

Figure 18:
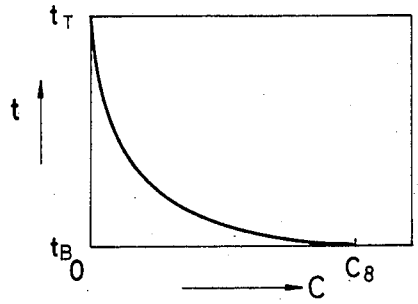

In the case of FIG. 18, the distribution concentration C of the atoms (OCN) is reduced gradually continuously from the concentration $C_8$ from the position $t_B$ up to the position $t_T$, to be made substantially zero at the position $t_T$.

Figure 19:
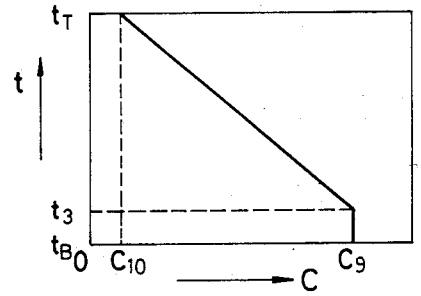

In the embodiment shown in FIG. 19, the distribution concentration C of the atoms (OCN) is made constantly $C_9$ between the position $t_B$ and the position $t_3$, and it is made the concentration $C_{10}$ at the position $t_T$. Between the position $t_3$ and the position $t_T$, the distribution concentration C is reduced as a first order function.

Figure 20:
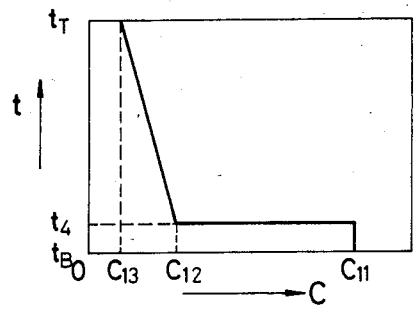

In the embodiment shown in FIG. 20, from the position $t_B$ to the position $t_4$, the distribution concentration C takes a constant value of $C_{11}$, while the distribution state is changed to a first order function in which the concentration is decreased from the concentration $C_{12}$ to the concentration $C_{13}$ from the position $t_4$ to the position $t_T$.

Figure 21:
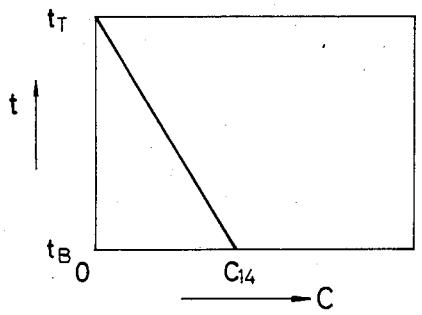

In the embodiment shown in FIG. 21, from the position $t_B$ to the position $t_T$, the distribution concentration C of the atoms (OCN) is reduced as a first order function from the concentration $C_{14}$ to substantially zero.

Figure 22:
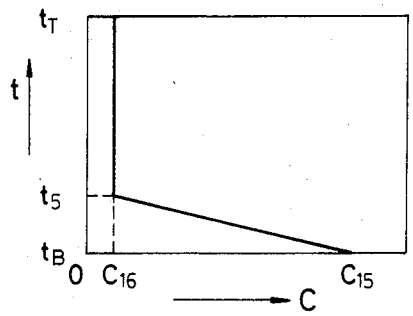

In FIG. 22, there is shown an embodiment, wherein from the position $t_B$ to the position $t_5$, the distribution concentration of the atoms (OCN) is reduced as a first order function from the concentration $C_{15}$ to $C_{16}$, and it is made constantly $C_{16}$ between the position $t_5$ and the position $t_T$.

Figure 23:
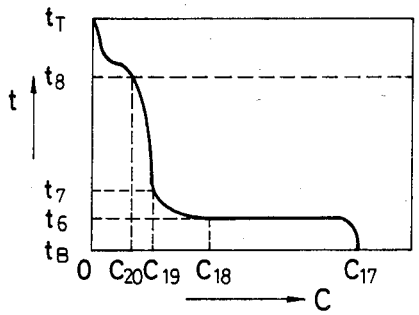

In the embodiment shown in FIG. 23, the distribution concentration C of the atoms (OCN) is $C_{17}$ at the position $t_B$, and, toward the position $t_6$, this $C_{17}$ is initially reduced gradually and then abruptly reduced near the position $t_6$, until it is made the concentration $C_{18}$ at the position $t_T$.

Between the position $t_6$ and the position $t_7$, the concentration is initially reduced abruptly and thereafter gently gradually reduced to become $C_{19}$ at the position $t_7$, and between the position $t_7$ and the position $t_8$, it is reduced gradually very slowly to become $C_{20}$ at the position $t_8$. Between the position $t_8$ and the position $t_T$, the concentration is reduced from the concentration $C_{20}$ to substantially zero along a curve with a shape as shown in the Figure.

As described above about some typical examples of depth profiles in the layer thickness direction of the atoms (OCN) contained in the layer region (OCN) by referring to FIGS. 15 through 23, it is desirable in the present invention that, when the atoms (OCN) are to be contained ununiformly in the layer region (OCN), the atoms (OCN) should be distributed in the layer region (OCN) with higher concentration on the substrate side, while having a portion in which the concentration considerably reduced on the interface $t_T$ side as compared with the substrate side.

The layer region (OCN) containing atoms (OCN) should desirably be provided so as to have a localized region (B) containing the atoms (OCN) at a relatively higher concentration on the substrate side as described above, and in this case, adhesion between the substrate and the light-receiving layer can be further improved.

The above localized region (B) may desirably be provided within 5μ from the interface position $t_B$, as explained in terms of the symbols indicated in FIGS. 15 through 23.

In the present invention, the above localized region (B) may occupy the whole or part of the layer region ($L_T$) which is within 5μ from the interface position $t_B$.

It may suitably be determined depending on the characteristics required for the light-receiving layer to be formed whether the localized region (B) is made a part or whole of the layer region ($L_T$).

The localized region (B) may preferably be formed to have a depth profile in the layer thickness direction such that the maximum value Cmax of the distribution concentration of the atoms (OCN) may preferably be 500 atomic ppm or more, more preferably 800 atomic ppm or more, most preferably 1000 atomic ppm or more.

In other words, in the present invention, the layer region (OCN) containing the atoms (OCN) may preferably be formed so that the maximum value Cmax of the distribution concentration C may exist within 5μ layer thickness from the substrate side (layer region with 5μ thickness from $t_B$).

In the present invention, when the layer region (OCN) is provided so as to occupy part of the layer region of the light-receiving layer, the depth profile of the atoms (OCN) should desirably be formed so that the refractive index may be changed moderately at the interface between the layer region (OCN) and other layer regions.

By doing so, reflection of the light incident upon the light-receiving layer from the interfaces between layers can be inhibited, whereby appearance of interference fringe pattern can more effectively be prevented.

It is also preferred that the distribution concentration C of the atoms (OCN) in the layer region (OCN) should be changed along a line which is changed continuously and moderately, in order to give smooth refractive index change.

In this regard, it is preferred that the atoms (OCN) should be contained in the layer region (OCN), so that the depth profile as shown in FIG. 15 through 18, FIG. 21 and FIG. 23 may be assumed.

In the present invention, formation of a photosensitive layer constituted of A—Si containing hydrogen atoms and/or halogen atoms (written as "A—Si(H,X)") may be conducted according to the vacuum deposition method utilizing discharging phenomenon, such as glow discharge method, sputtering method or ion-plating method. For example, for formation of a photosensitive layer constituted of A—Si(H,X) according to the glow discharge method, the basic procedure comprises introducing a starting gas for Si supply capable of supplying silicon atoms, optionally together with a starting gas for introduction of hydrogen atoms (H) and/or a starting gas for introduction of halogen atoms (X), into a deposition chamber which can be brought internally to a reduced pressure and exciting glow discharge in said deposition chamber, thereby forming a layer comprising A—Si(H,X) on a desired substrate placed at a predetermined position. Alternatively, for formation according to the sputtering method, gases for introduction of hydrogen atoms (H) and/or halogen atoms (X), which may optionally be diluted with a diluting gas such as He, Ar, etc., may be introduced into a deposition chamber to form a desired gas plasma atmosphere when effecting sputtering of a target constituted of Si in an inert gas such as Ar, He, etc. or a gas mixture based on these gases.

In the case of the ion-plating method, for example, a vaporizing source such as a polycrystalline silicon or a single crystalline silicon may be placed in a evaporating boat, and the vaporizing source is heated by the resistance heating method or the electron beam method (EB method) to be vaporized, and the flying vaporized product is permitted to pass through a desired gas plasma atmosphere, otherwise following the same procedure as in the case of sputtering.

The starting gas for supplying Si to be used in the present invention may include gaseous or gasifiable hydrogenated silicons (silanes) such as $SiH_4$, $Si_2H_6$, $Si_3H_8$, $Si_4H_{10}$ as effective materials. In particular, $SiH_4$ and $Si_2H_6$ are preferred with respect to easy handling during layer formation and efficiency for supplying Si.

Effective starting gases for introduction of halogen atoms to be used in the present invention may include a large number of halogenic compounds, as exemplified preferably by halogen gases, halides, interhalogen compound or gaseous or gasifiable halogenic compounds such as silane derivatives substituted with halogens.

Further, there may also be included gaseous or gasifiable hydrogenated silicon compounds containing silicon atoms and halogen atoms as constituent elements as effective ones in the present invention.

Typical examples of halogen compounds preferably used in the present invention may include halogen gases such as fluorine, chlorine, bromine or iodine, interhalogen compoudns such as BrF, ClF, $ClF_3$, $BrF_5$, $BrF_3$, $IF_3$, $IF_7$, ICl, IBr, etc.

As the silicon compounds containing halogen compound, namely so called silane derivatives substituted with halogens, there may preferably be employed silicon halides such as $SiF_4$, $Si_2F_6$, $SiCl_4$, $SiBr_4$ and the like.

When the characteristic light-receiving member of the present invention is formed according to the glow discharge method by employment of such a silicon compound containing halogen atoms, it is possible to form the photosensitive layer comprising A—Si containing halogen atoms on a desired substrate without use of a hydrogenated silicon gas as the starting gas capable of supplying Si.

In the case of forming the photosensitive layer containing halogen atoms according to the glow discharge method, the basic procedure comprises, for example, introducing a silicon halide as the starting gas for Si supply and a gas such as Ar, $H_2$, He, etc. at a predetermined mixing ratio into the deposition chamber for formation of the photosensitive layer and exciting glow discharge to form a plasma atmosphere of these gases, whereby the photosensitive layer can be formed on a desired substrate. In order to control the ratio of hydrogen atoms incorporated more easily, hydrogen gas, or a gas of a silicon compound containing hydrogen atoms may also be mixed with these gases in a desired amount to form the layer.

Also, each gas is not restricted to a single species, but multiple species may be available at any desired ratio.

In either case of the sputtering method and the ion-plating method, introduction of halogen atoms into the layer formed may be performed by introducing the gas of the above halogen compound or the above silicon compound containing halogen atoms into a deposition chamber and forming a plasma atmosphere of said gas.

On the other hand, for introduction of hydrogen atoms, a starting gas for introduction of hydrogen atoms, for example, $H_2$ or gases such as silanes and/or germanium hydride and the like may be introduced into a deposition chamber for sputtering, followed by formation of the plasma atmosphere of these gases.

In the present invention, as the starting gas for introduction of halogen atoms, the halides or halo-containing silicon compounds as mentioned above can be effectively used. Otherwise, it is also possible to use effectively as the starting material for formation of the photosensitive layer gaseous or gasifiable substances, including hydrogen halides such as HF, HCl, HBr, HI, etc.; halo-substituted hydrogenated silicon such as $SiH_2F_2$, $SiH_2I_2$, $SiH_2Cl_2$, $SiHCl_3$, $SiH_2Br_2$, $SiHBr_3$, etc.

Among these substances, halides containing hydrogen atoms can preferably be used as the starting material for introduction of halogens, because hydrogen atoms, which are very effective for controlling electrical or photoelectric characteristics, can be introduced into the layer simultaneously with introduction of halogen atoms during formation of the photosensitive layer.

For introducing the substance (C) for controlling conductivity, for example, the group III atoms or the group V atoms structurally into the charge injection preventive layer or the photosensitive layer constituting the light-receiving layer, the starting material for introduction of the group III atoms or the starting material for introduction of the group V atoms may be introduced under gaseous state into a deposition chamber together with other starting materials for formation of the an amorphous layer. As the material which can be used as such starting materials for introduction of the group III atoms or the group V atoms, there may be desirably employed those which are gaseous under the conditions of normal temperature and normal pressure, or at least readily gasifiable under layer forming conditions. Examples of such starting materials for introducion of the group III atoms includes boron hydrides such as $B_2H_6$, $B_4H_{10}$, $B_5H_9$, $B_5H_{11}$, $B_6H_{10}$, $B_6H_{12}$, $B_6H_{14}$ and the like, boron halides such as $BF_3$, $BCl_3$, $BBr_3$ and the like. In addition, there may also be included $AlCl_3$, $GaCl_3$, $Ga(CH_3)_3$, $InCl_3$, $TlCl_3$ and the like.

Examples of the starting materials for introduction of the group V atoms are phosphorus hydrides such as $PH_3$, $P_2H_4$ and the like, phosphorus halides such as $PH_4I$, $PF_3$, $PF_5$, $PCl_3$, $PCl_5$, $PBr_3$, $PBr_5$, $PI_3$ and the like. In addition, there may also be included $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$ and the like, as effective materials for introduction of the group V atoms.

In the present invention, for provision of a layer region (OCN) containing the atoms (OCN) in the light-receiving layer, a starting material for introduction of the atoms (OCN) may be used together with the starting material for formation of the light-receiving layer during formation of the light-receiving layer and incorporated in the layer formed while controlling its amount.

When the flow discharge method is employed for formation of the layer region (OCN), a starting material for introduction of the atoms (OCN) is added to the material selected as desired from the starting materials for formation of the light-receiving layer as described above. For such a starting material for introduction of the atoms (OCN), there may be employed most of gaseous or gasified gasifiable substances containing at least the atoms (OCN) as the constituent atoms.

More specifically, there may be included, for example, oxygen ($O_2$), ozone ($O_3$), nitrogen monoxide (NO), nitrogen dioxide ($NO_2$), dinitrogen monoxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$); lower siloxanes containing silicon atom (Si), oxygen atom (O) and hydrogen atom (H) as constituent atoms, such as disiloxane ($H_3SiOSiH_3$), trisiloxane ($H_3SiOSiH_2OSiH_3$), and the like; saturated hydrocarbons having 1–5 carbon atoms such as methane ($CH_4$), ethane ($C_2H_6$), propane ($C_3H_8$), n-butane (n-$C_4H_{10}$), pentane ($C_5H_{12}$); ethylenic hydrocarbons having 2–5 carbon atoms such as ethylene ($C_2H_4$), propylene ($C_3H_6$), butene-1 ($C_4H_8$), butene-2 ($C_4H_8$), isobutylene ($C_4H_8$), pentene ($C_5H_{10}$); acetylenic hydrocarbons having 2–4 carbon atoms such as acetylene ($C_2H_2$), methyl acetylene ($C_3H_4$), butyne ($C_4H_6$); and the like; nitrogen ($N_2$), ammonia ($NH_3$), hydrazine ($H_2NNH_2$), hydrogen azide ($HN_3$), ammonius azide ($NH_4N_3$), nitrogen trifluoride ($F_3N$), nitrogen tetrafluoride ($F_4N$) and so on.

In the case of the sputtering method, as the starting material for introduction of the atoms (OCN), there may also be employed solid starting materials such as $SiO_2$, $Si_3N_4$ and carbon black in addition to those gasifiable as enumerated above for the glow discharge method. These can be used in the form of a target for sputtering together with the target of Si, etc.

In the present invention, when forming a layer region (OCN) containing the atoms (OCN) during formation of the light-receiving layer, formation of the layer region (OCN) having a desired depth profile of the atoms (OCN) in the direction of layer thickness formed by varying the distribution concentration C of the atoms (OCN) contained in said layer region (OCN) may be conducted in the case of glow discharge by introducing a starting gas for introduction of the atoms (OCN) the distribution concentration C of which is to be varied into a deposition chamber, while varying suitably its gas flow rate according to a desired rate of change curve.

For example, by the manual method or any other method conventionally used such as an externally driven motor, etc., the opening of certain needle valve provided in the course of the gas flow channel system may be gradaully varied. During this operation, the rate of variation is not necessarily required to be linear, but the flow rate may be controlled according to a rate of change curve previously designed by means of, for example, a microcomputer to give a desired content curve.

When the layer region (OCN) is formed according to the sputtering method, formation of a desired depth profile of the atoms (OCN) in the layer thickness direction by varying the distribution concentration C of the atoms (OCN) may be performed, first similarly as in the case of the glow discharge method by employing a starting material for introduction of the atoms (OCN) under gaseous state and varying suitably as desired the gas flow rate of said gas when introduced into the deposition chamber. Secondly, formation of such a depth profile can also be achieved by previously changing the composition of a target for sputtering. For example, when a target comprising a mixture of Si and $SiO_2$ is to be used, the mixing ratio of Si to $SiO_2$ may be varied in the direction of layer thickness of the target.

Figure 24:
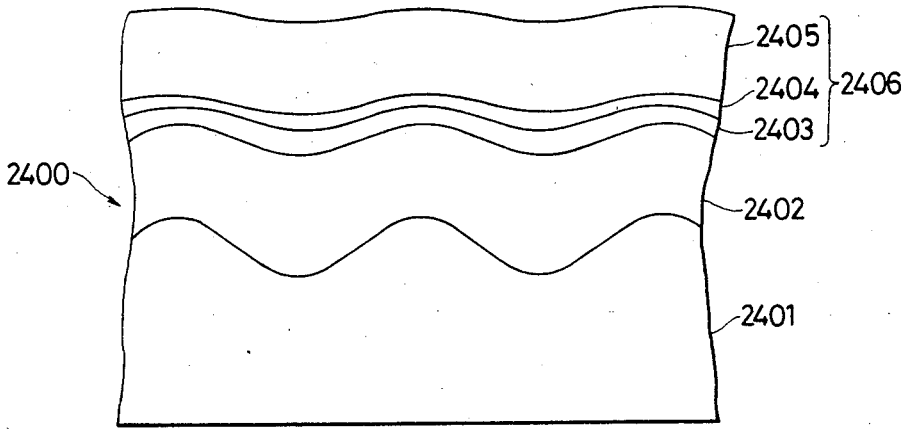

FIG. 24 shows another preferred embodiment of the present invention. The light-receiving member for electrophotography shown in FIG. 24 has a light-receiving layer with a multi-layer structure comprising an electroconductive layer 2402, a barrier layer 2403, a charge generation layer 2404 and as charge transport layer 2405 provided on an electroconductive substrate 2401 having a minute and smooth unevenness.

As the electroconductive layer 2402 as mentioned above, it is possible to use a vapor deposition film of an electroconductive metal such as aluminum, tin, gold, etc. or coated film containing electroconductive powder dispersed in a resin. The electroconductive powder to be used in this case may include metallic powder of aluminum, tin, silver, etc., carbon powder and electroconductive pigments composed mainly of metal oxides such as titanium oxide, barium sulfate, zinc oxide, tin oxide, etc. A light absorber may also be contained in the electroconductive layer 2402.

The resin for dispersing an electroconductive pigment may be any kind of resins, which can satisfy the conditions of (1) having film adhesion to the substrate, (2) having good dispersibility of powder and (3) having sufficient solvent resistance. In particular, it is suitable to use thermosetting resins such as ebonite, polyurethane resin, epoxy resin, alkyd resin, polyester resin, silicone resin, acrylic-melamine resin, etc. The resin containing an electroconductive pigment dispersed therein may have a volume resistivity of $10^{13}$ ohm cm or less, preferably $10^{12}$ ohm cm or less. For this purpose, it is desirable that the electroconductive pigment is contained at a proportion of 10 to 60% by weight in the coated film.

The electroconductive layer 2402 can incorporate a surface energy lowering agent such as silicone oil or various kinds of surfactants, whereby a uniform coated surface with small defect of coated film can be obtained. As the method for dispersing electroconductive powder in a resin, it is possible to use conventional methods by means of roll mill, ball mill, vibrating ball mill, attritor, sand mill, colloid mill, etc. In the case when the substrate is shaped in a sheet, wire bar coating, blade coating, knife coating, roll coating or screen coating may suitably be employed, while dip coating is suitable in the case of a cylindrical substrate.

The electroconductive layer 2402 may be formed to have a thickness generally of 1 μm to 50 μm, preferably of 5 μm to 30 μm. With such a thickness, the surface thickness of the substrate 2401, when having a projection with a height h of 100 μm or less on the substrate 2401, can sufficiently be shielded.

Between the electroconductive layer 2402 and the charge generation layer 2404, there is provided a barrier layer 2403 having the barrier function exhibiting electrical barrier effect and the adhesion function.

The varrier layer 2403 may be formed of casein, polyvinyl alcohol, nitrocellulose, ethyleneacrylic acid copolymer, polyamide (nylon 6, nylon 66, nylon 610, copolymerized nylon, alkoxymethylated nylon, etc.), polyurethane, gelatin, etc.

The thickness of the barrier layer 2403 can be made preferably 0.1μ to 5 μ, more preferalby 0.5μto 5 μ.

The charge generation layer 2404 is formed by dispersing a charge generation material selected from azo pigments such as Sudan Red, Dian Blue, Janus Green B, etc.; quinone pigments such as Argol Yellow, Pyrene Quinone, Indanthrene Brilliant Violet RRP, etc.; quinocyanine pigments; perylene pigments; indigo pigments such as indico, thioindigo, etc.; bisbenzoimidazole pigments such as Indian Fast Orange Toner, etc.; phthalocyanine pigments such as copper phthalocyanine, Alumichlorophthalocyanine, etc.; quinacridone pigments; or azulene compounds in a binder resin such as polyester, polystyrene, polyvinyl butyral, polyvinyl pyrrolidone, methyl cellulose, polyacrylates, cellulose ester, etc. Its thickness may be preferably about 0.01μ to 1μ, more preferably 0.05μ to 0.5μ.

On the other hand, the charge transport layer 2405 may be formed by dissolving a positive hole transporting material selected from compounds having in the main chain or the side chain polycyclic aromatic compounds such as anthracene, pyrene, phenanthrene, coronene, etc. or nitrogen-containing cyclic compounds such as indole, carbazole, oxazole, isooxazole, thiazole, imidazole, pyrazole, oxadiazole, pyrazoline, thiadiazole, triazole, etc, or hydrazone compounds in a resin having a film-forming property. This is because charge transporting materials are generally low in molecular weights and themselves poor in film-forming property. Such resins may include polycarbonate, polymethacrylates, polyallylate, polystyrene, polyester, polysulfone, styreneacrylonitrile copolymer, styrene-methyl methacylate copolymer, etc.

The thickness of the charge transport layer 2405 may be 5μ to 20μ. It is also possible to form a photosensitive layer with a structure having the charge generation layer 2404 as described above laminated on the charge transport layer 2405.

The photosensitive layer is not limited to the modes as described above, but there may also be employed, for example, photosensitive layers, in which a charge transfer complex comprising polyvinylcarbazole and trinitrofluorenone as disclosed in IBM Journal of the Research and Development, January, 1971, p. 75–p. 89, or a pyrylium type compound as disclosed in U.S. Pat. Nos. 4315983 and 4327169 us used, or a photosensitive layer containing a well-known inorganic photoconductive material such as zinc oxide or cadmium sulfide dispersed in a resin, or a vapor deposition type photosensitive layer such as selenium, selenium-tellurium, arsenic selenide, etc.

The present invention is described by referring to the following Examples.

EXAMPLE 1

Figure 10:
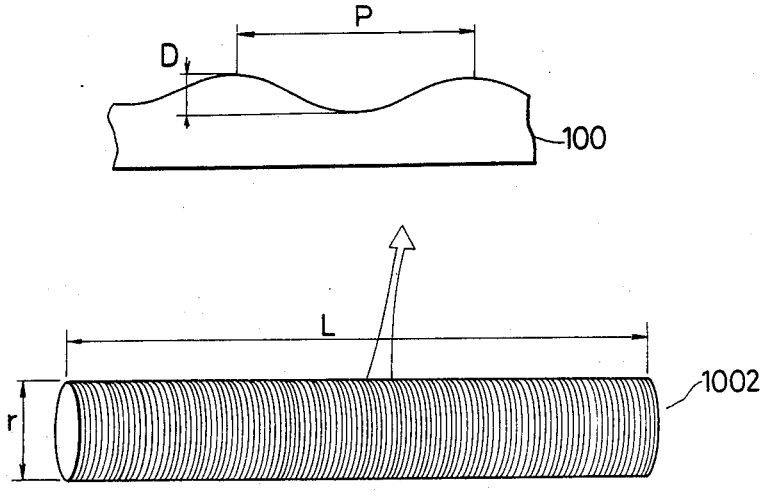
FIG. 10 is a schematic illustration of the surface condition of the aluminum substrate employed in Example 1.

In this Example, a semiconductor laser (wavelength: 780 nm) with a spot size of 80 μm was employed. Thus, on a cylindrical aluminum substrate (length (L) 357 mm, outer diameter (r) 80 mm) on which A—Si:H is to be deposited, a spiral groove was prepared by a lathe with a pitch (P) of 25 μm and a depth (D) of 0.8 S. The form of the groove is shown in FIG. 10.

Figure 11:
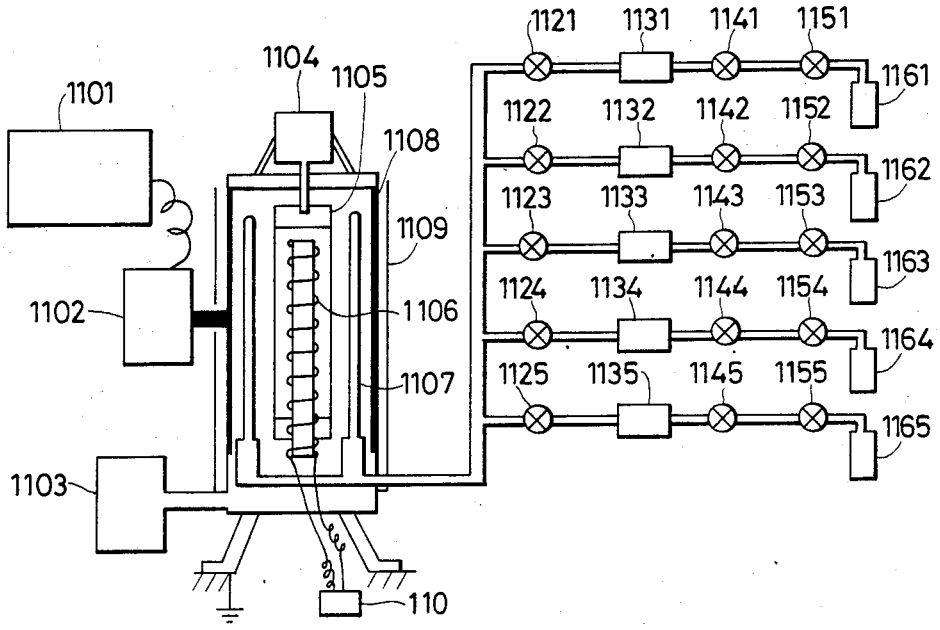
FIG. 11 is a schematic illustration of a device for deposition of light-receiving layer employed in Examples.

On this aluminum substrate, the charge injection preventive layer and the photosensitive layer were deposited by means of the device as shown in FIG. 11 in the following manner.

First, the constitution of the device is to be explained. 1101 is a high frequency power source, 1102 is a matching box, 1103 is a diffusion pump and a mechanical booster pump, 1104 is a motor for rotation of the aluminum substrate, 1105 is an aluminum substrate, 1106 is a heater for heating the aluminum substrate, 1107 is a gas inlet tube, 1108 is a cathode electrode for introduction of high frequency, 1109 is a shield plate, 1110 is a power source for heater, 1121 to 1125, 1141 to 1145 are valves, 1131 to 1135 are mass flow controllers, 1151 to 1155 are regulators, 1161 is a hydrogen ($H_2$) bomb, 1162 is a silane ($SiH_4$) bomb, 1163 is a diborane ($B_2H_6$) bomb, 1164 is a nitrogen monoxide (NO) bomb and 1165 is a methane ($CH_4$) bomb.

Next, the preparation procedure is to be explained. All of the main cocks of the bombs 1161–1165 were closed, all the mass flow controllers and the valves were opened and the deposition device was internally evacuated by the diffusion pump 1103 to $10^{-7}$ Torr. At the same time, the aluminum substrate 1105 was heated by the heater 1106 to 250° C. and maintained constantly at 250° C. After the temperature of the aluminum substrate 1105 became constantly at 250° C., the valves 1121–1125, 1141–1145 and 1151–1155 were closed, the main cocks of bombs 1161–1165 were opened and the diffusion pump 1103 was changed to the mechanical booster pump. The secondary pressure of the valves equipped with regulators 1151–1155 was set at 1.5 kg/cm$^2$. The mass flow controller 1131 was set at 300 SCCM, and the valves 1141 and 1121 were successively opened to introduce $H_2$ gas into the deposition device.

Next, by setting the mass flow controller 1132 at 150 SCCM, $SiH_4$ gas in bomb 1162 was introduced into the deposition device according to the same procedure as introduction of $H_2$ gas. Then, by setting the mass flow controller 1133 so that the flow rate of $B_2H_6$ gas in bomb 1163 may be 1600 Vol.ppm relative to $SiH_4$ gas flow rate, $B_2H_6$ gas was introduced into the deposition device according to the same procedure as introduction of $H_2$ gas.

When the inner pressure in the deposition device was stabilized at 0.2 Torr, the high frequency power source 1101 was turned on and glow discharge was generated between the aluminum substrate 1105 and the cathode electrode 1108 by controlling the matching box 1102, and an A—Si:H:B layer (p-type A—Si:H layer containing B) was deposited to a thickness of 5 μm at a high frequency power of 150 W (charge injection preventive layer). After deposition of a 5 μm thick A—Si:H:B layer (p-type), inflow of $B_2H_6$ was stopped by closing the valve 1123 without discontinuing discharge.

And, A—Si:H layer (non-doped) with a thickness of 20 μm was deposited at a high frequency power of 150 W (photosensitive layer). Then, with the high frequency power source and all the valves being closed, the deposition device was evacuated, the temperature of the aluminum substrate was lowered to room temperature and the substrate on which the light receiving layer was formed was taken out.

Figure 12:
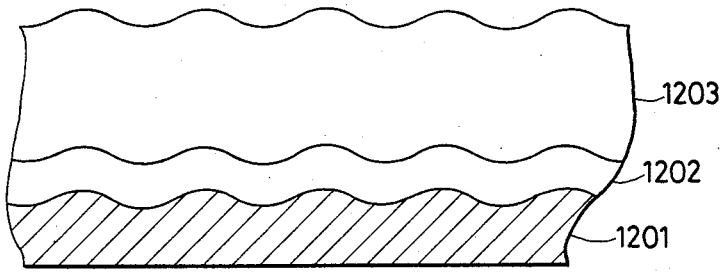
FIG. 12 and FIG. 13 are each structural view of the light-receiving member prepared in Example 1.

Separately, when a charge injection preventive layer and a photosensitive layer were formed on the same cylindrical aluminum substrate with the same surface characteristic under the same conditions and according to the same procedure as in the above case except for changing the high frequency power to 50 W, the surface of the photosensitive layer 1203 was found to be parallel to the surface of the substrate 1201, as shown in FIG. 12. The difference in the total layer thickness between the center and the both end portions of the aluminum substrate was 1 μm.

Figure 13:
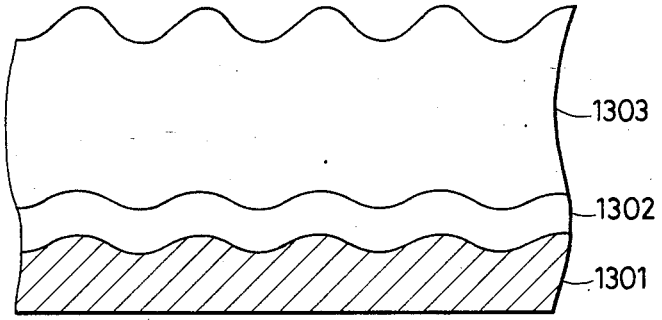

When the above high frequency power was made 150 W, the surface of the photosensitive layer 1303 and the surface of the substrate 1301 were unparallel to each other as shown in FIG. 13. In this case, the layer thickness difference in average layer thickness between the center and the both end portions was 2 μm.

Figure 14:
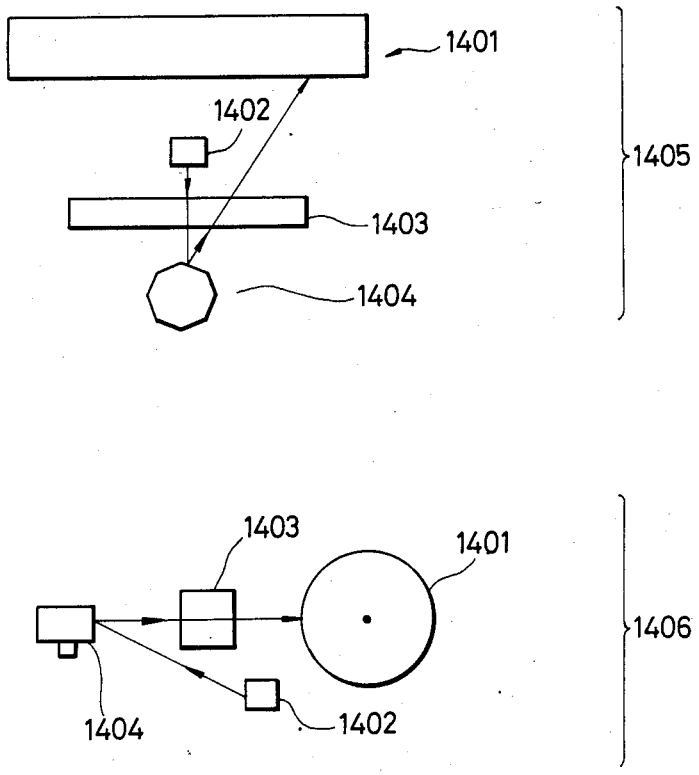
FIG. 14 is a schematic illustration of an image exposure device employed in Examples.

For the two kinds of the light receiving members for electrophotography, image exposure was effected by means of the device shown in FIG. 14 with a semiconductor laser of a wavelength 780 nm with a spot size of 80 μm, followed by developing and transfer to obtain images. In the light receiving member with the surface characteristic as shown in FIG. 14 prepared at a high frequency power of 50 W, interference fringe pattern was observed.

On the other hand, in the light receiving member having the surface characteristic as shown in FIG. 13, no interference fringe pattern was observed and there could be obtained a member exhibiting practically satisfactory electrophotographic characteristics.

EXAMPLE 2

The surfaces of cylindrical aluminum substrates were worked by a lathe as shown in Table 1*a*. On these (Nos. 101*a*–108*a*) aluminum substrates were prepared light receiving members for electrophotography under the same conditions as in Example 1 where no interference fringe pattern was observed (high frequency power 150 W) (Nos. 111*a*–118*a*. The difference in average layer thickness between the center and the both end portions of the aluminum substrate in the light receiving member for electrophotography was 2 μm.

The cross-sections of these light receiving members for electrophotography were observed by an electron microscope and the differences within the pitch of the photosensitive layer were measured to obtain the results as shown in Table 2*a*. For these light receiving members, image exposure was effected by means of the same device as shown in FIG. 14 similarly as in Example 1 using a semiconductor laser of wavelength 780 nm with a spot size of 80 μm to obtain the results as shown in Table 2*a*.

EXAMPLE 3

Light receiving members were prepared under the same conditions as in Example 2 except for the following points (No. 121*a*–128*a*. The charge injection preventive layer was made to have a thickness of 10 μm. The difference in average layer thickness between the center and the both ends of the charge injection preventive layer was 1 μm, with the average difference in thickness distribution between the center and the both ends of the photosensitive layer was 2 μm. When the thickness of each layer of Nos. 121*a*–128*a* was observed by an electron microscope, the results as shown in Table 3*a* were obtained. For these light receiving members, image exposure was conducted in the same image exposure device as in Example 1 to obtain the results as shown in Table 3*a*.

EXAMPLE 4

On cylindrical aluminum substrates (Nos. 201*a*–207*a*) having the surface characteristic as shown in Table 4*a*, light receiving members provided with silicon oxide layer as the charge injection preventive layer were prepared as follows.

The silicon oxide layer was formed under the same conditions as the preparation of the charge injection preventive layer in Example 2, except for changing the flow rate of $SiH_4$ to 50 SCCM and that of NO to 60 SCCM, to a thickness of 0.2 μm.

On the silicon oxide layer was formed a photosensitive layer with a thickness of 20 μm under the same conditions as in Example 2.

The difference in average layer thickness between the center and both ends of the light receiving member for electrophotography thus prepared was 1 μm.

When these photosensitive memgers were observed by an electron microscope, the difference in the layer thickness of the silicon oxide layer within the pitch on the surface of the aluminum cylinder was 0.06 μm. Similarly, the difference in the layer thickness of A—Si:H photosensitive layer can be seen from the results shown in Table 5*a*. When these light receiving members for electrophotography were subjected to image exposure with laser beam similarly as described in Example 1, the results as shown in Table 5*a* were obtained.

EXAMPLE 5

Light receiving members having a silicon nitride layer as the charge injection preventive layer provided on cylindrical aluminum substrates having surface characteristics as shown in Table 4*a* (Nos. 201*a*–207*a*) were prepared as follows.

The silicon nitride layer was formed by replacing NO gas with $NH_3$ gas and changing the flow rate of $SiH_4$ gas to 30 SCCM and the flow rate of $NH_3$ gas to 200 SCCM in Example 4, following otherwise the same conditions as in preparation of the charge injection preventive layer in Example 2, to a thickness of 0.2 μm.

On the silicon nitride layer was formed a photosensitive layer to a thickness of 20 μm similarly as in Example 2 except for changing the high frequency power to 100 W. The difference in average thickness between the center and the both ends of the light receiving member thus prepared was 1 μm.

When the layer thickness difference within each pitch in the light receiving member for electrophotography was measured by an electron microscope, the layer thickness difference was 0.05 μm or less in the silicon nitride layer.

On the other hand, in the A—Si:H light receiving layer, the layer thickness difference within each pitch can be seen from the results shown in Table 6*a*.

These light receiving members for electrophotography (Nos. 221*a*–227*a*) were subjected to image exposure with laser beam similarly as in Example 1 to obtain the results as shown in Table 6*a*.

EXAMPLE 6

Light receiving members having a silicon carbide layer provided as the charge injection preventive layer on the cylindrical aluminum substrates (Nos. 201*a*–207*a*) having surface characteristics as shown in Table 4*a* were prepared as follows.

The silicon carbide layer was formed with the use of $CH_4$ gas and $SiH_4$ gas at a flow rate of $CH_4$ gas of 600 SCCM and flow rate of $SiH_4$ gas of 20 SCCM, following otherwise the same conditions as in preparation of the charge injection preventive layer in Example 2, to a thickness of 0.3 μm.

On the silicon carbide layer, A—Si:H photosensitive layer was formed to a thickness of 20 μm at a high frequency power of 200 W under otherwise the same conditions as in Example 2.

The difference in average layer thickness between the center and the both ends of the A—Si light receiving member for electrophotography thus prepared was 1.5 μm.

When the light receiving member for electrophotography of A—Si was observed by an electron microscope, the difference in layer thickness within each pitch was 0.07 μm in the silicon carbide layer.

On the other hand, the difference in layer thickness within each pitch in A—Si:H layer can be seen from the results as shown in Table 7*a*.

These light receiving members for electrophotography (Nos. 231*a*–237*a*) were subjected to image exposure with laser beam similarly as in Example 1 to obtain the results as shown in Table 7*a*.

EXAMPLE 7

A cutting tool was fixed to a lathe so that the cutting blade can push a cylindrical aluminum substrate, 60 mm in diameter and 258 mm long, at one end to cut the cylindrical aluminum substrate to the depth of 1.8 μm from the surface, and was moved along the cylindrical aluminum substrate to the other end at a moving speed of 200 μm per revolution of the cylindrical aluminum while rotating the cylindrical aluminum substrate to effect machine cutting, whereby tapered reflective surfaces having the uneven cross-sectional shape as shown in FIG. 24 were formed at pitches of 200 μm.

The surface of the thus machine cut cylindrical aluminum substrate was investigated by a universal surface shape measuring instrument (SE-3C made by Osaka Kenkyusho, Japan), and it was found that the uneven shape of a sine wave function with a height of 1.8 μm and a width of 200 mm were regularly formed at pitches of 200 μm.

Then, 25 parts by weight of titanium oxide (ECT-62, made by Titan Kogyo K.K., Japan), 25 parts by weight of titanium oxide (SR-IT, made by Sakai Kogyo K.K., Japan) and phenol resin (Plyophen J325, made by Dainihon Ink Kogyo K.K., Japan) were mixed with 500 parts by weight of methanol and methylcellosolve in a ratio of methanol:methylcellosolve=4:15 by weight with stirring, and the mixture was dispersed in a sand mill disperser together with 50 parts by weight of glass beads of diameter 1 mm for 10 hours. The resulting dispersion was admixed with 50 ppm of silicone oil (SH289A, made by Toshiba Silicone K.K., Japan) in terms of solid matters with stirring, whereby a coating solution for forming an electroconductive layer was prepared.

The thus prepared coating solution was applied to the surface of the said machine cut aluminum cylinder by dipping to obtain a film thickness of 20 μm after drying, and then the coating was dried by heating at 140° C. for 30 minutes, whereby an electroconductive layer was formed.

Then, 10 parts by weight of nylon copolymer resin (CM-8000, made by Toray K.K., Japan) was dissolved in a mixture of 60 parts by weight of methanol and 40 parts by weight of butanol, and the resulting solution was applied onto the electroconductive layer by dipping to provide a polyamide resin layer having the thickness of 1 μm.

Then, 1 part by weight of Σ-type copper phthalocyanine (Linol Blue ES, made by Toyo Ink K.K., Japan), 1 part by weight of butyral resin (Eslec BM-2, made by Sekisui Kagaku K.K., Japan), and 10 parts by weight of cyclohexanone were dispersed in a sand mill disperser containing glass beads, 1 mm in diameter, for 20 hours, and then the resulting dispersion was diluted with 20 parts by weight of methylethylketone. The resulting dispersion was applied onto the previously formed polyamide resin layer by dipping and dried to provide a charge generation layer having a thickness of 0.3 μm.

Then, 10 parts by weight of a hydrazone compound having the following structural formula:

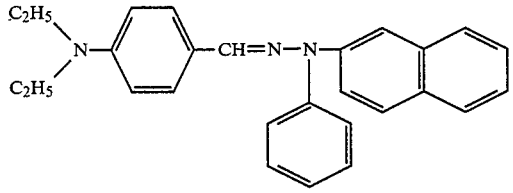

and 15 parts by weight of styrene-methyl methacrylate copolymer resin (MS200, made by Seitetsu Kagaku K.K., Japan) were dissolved in 80 parts by weight of toluene. The resulting solution was applied onto the charge generation layer and dried is hot air at 100° C. for one hour to provide a charge transport layer having a thickness of 16 μm.

The thus prepared electrophotographic photosensitive member was mounted on Canon laser beam printer (LBP-CX, made by Canon Kabushiki Kaisha, Japan), a reversal development type, electrophotographic printer using a semiconductor laser having the oscillation wavelength of 778 nm, and subjected to line scanning on the whole surface to form a whole surface image of black toner. No interference fringe pattern appeared at all on the whole surface black image.

Then, the member was subjected to 2,000 repetitions of an operation of line scanning with the laser beam according to a letter signal at the temperature of 15° C. and the relative humidity of 10% to form the letter image, and the 2000th copy of letter image was investigated by counting the number of black dots having a diameter of 0.2 mm or more on the copy of letter image. No black dots were found at all.

EXAMPLE 8

10 g of fine zinc oxide particles (Sazex 2000, made by Sakai Kagaku K.K., Japan), 4 g of acrylic resin (Dianal LR009, made by Mitsubishi Rayon K.K., Japan), 10 g of toluene, and 10 mg of an azulenium compound having the following structural formula:

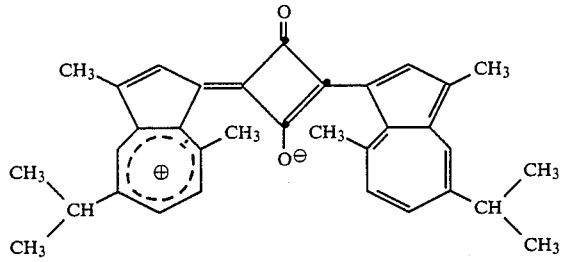

were thoroughly mixed in a ball mill to prepare a coating solution for forming a photosensitive layer. An light receiving member for electrophotography was prepared in the same manner as in Example 7, except that the resulting coating solution was used to form a photosensitive layer having a thickness of 21 μm after drying in place of the photosensitive layer of lamination type comprising the charge generation layer and the charge transport layer used in Example 7.

The thus prepared light receiving member was mounted on the same laser beam printer as used in Example 7 except that the electric charger was changed to make the charge positive and subjected to the same investigation. It was found that no interference fringe pattern was observed on the whole surface black image and no black dots having a diameter of 0.2 mm or more were observed on the 2,000th copy of letter image, and thus a very good image was obtained.

EXAMPLE 9

The same cylindrical aluminum substrate as machine cut in Example 7 was subjected to anodic oxidation according to the conventional method to form a film of aluminum oxide, and a layer of arsenic selenide (tellurium, 10% by weight) was formed thereon to a thickness of 15 μm by vacuum vapor deposition.

The thus prepared light receiving member for an electrophotography member was mounted on the same laser beam printer as used in Example 8 and subjected to the same investigation as in Example 8. The same results as in Example 8 were obtained.

EXAMPLE 10

A cutting tool was fixed to a lathe so that the cutting blade can push a cylindrical aluminum, 60 mm in diameter and 258 mm long, at one end to cut the cylindrical aluminum to the depth of 1.8 μm from the surface, and moved along the cylindrical aluminum substrate to the other end at a moving speed of 20 μm per revolution of the cylindrical aluminum substrate to effect machine cutting.

The surface of the thus machine cut cylindrical aluminum substrate was investigated by a universal surface shape tester (SE-3C, made by Osaka Kenkyusho, Japan) and it was found that reflective surfaces a sine wave function shape with a height of 0.8 μm and a width of 20 μm were regularly formed at pitches of 20 μm.

The same electroconductive layer, polyamide resin layer, charge generation layer and charge transport layer as used in Example 7 were successively formed on the aluminum cylinder by coating to prepare an electrophotographic photosensitive member. The member was mounted on the same laser beam printer as used in Example 8 and images were formed in the same manner as in Example 8. As a result, it was found that no interference fringe pattern was observed at all on the whole surface black image and no black dots were observed at all on the 2,000th copy of letter image.

COMPARATIVE EXAMPLE 1

As a comparative test, an A—Si light receiving member for electrophotography was prepared according to entirely the same method as the light receiving member for electrophotography prepared at a high frequency power of 150 W in Example 1 except for employing an aluminum substrate whose surface had been roughened by the sand blast method in place of the aluminum substrate used in preparation of the light receiving member for electrophotography in Example 1. The surface condition of the aluminum substrate subjected to the surface roughening treatment by the sand blast method was subjected to measurement before provision of the light receiving layer by means of the universal surface shape measuring instrument (SE-3C) produced by Kosaka Research Institute to find that the average surface roughness was 1.8 μm.

The comparative light receiving member for electrophotography was mounted on the device shown in FIG. 14 as employed in Example 1 and similar measurement was conducted. As the result, clear interference fringe was found to be formed in the black image over the whole surface.

EXAMPLE 11

In this Example, a semiconductor laser (wavelength: 780 nm) with a spot size of 80 μm was employed. Thus, on a cylindrical aluminum substrate (length (L) 357 mm, outer diameter (r) 80 mm) on which A—Si:H is to be deposited, a spiral groove was prepared by a lathe with a pitch (P) of 25 μm and a depth (D) of 0.8 S. The form of the groove is shown in FIG. 10.

On this aluminum substrate, the charge injection preventive layer and the photosensitive layer were deposited by means of the device as shown in FIG. 11 in the following manner.

First, the constitution of the device is to be explained. 1101 is a high frequency power source, 1102 is a matching box, 1103 is a diffusion pump and a mechanical booster pump, 1104 is a motor for rotation of the aluminum substrate, 1105 is an aluminum substrate, 1106 is a heater for heating the aluminum substrate, 1107 is a gas inlet tube, 1108 is a cathode electrode for introduction of high frequency, 1109 is a shield plate, 1110 is a power source for heater, 1121 to 1125, 1141 to 1145 are valves, 1131 to 1135 are mass flow controllers, 1151 to 1155 are regulators, 1161 is a hydrogen ($H_2$) bomb, 1162 is a silane ($SiH_4$) bomb, 1163 is a diborane ($B_2H_6$) bomb, 1164 is a nitrogen monoxide (NO) bomb and 1167 is a methane ($CH_4$) bomb.

Next, the preparation procedure is to be explained. All of the main cocks of the bombs 1161–1165 were closed, all the mass flow controllers and the valves were opened and the deposition device was internally evacuated by the diffusion pump 1103 to $10^{-7}$ Torr. At the same time, the aluminum substrate 1105 was heated by the heater 1106 to 250° C. and maintained constantly at 250° C. After the temperature of the aluminum substrate 1105 became constantly at 250° C., the valves 1121–1125, 1141–1145 and 1151–1155 were closed, the main cocks of bombs 1161–1165 were opened and the diffusion pump 1103 was changed to the mechanical booster pump. The secondary pressure of the valves equipped with regulators 1151–1155 was set at 1.5 kg/cm$^2$. The mass flow controller 1131 was set at 300 SCCM, and the valves 1141 and 1121 were successively opened to introduce $H_2$ gas in bomb 1161 into the deposition device.

Next, by setting the mass flow controller 1132 at 150 SCCM, $SiH_4$ gas in bomb 1162 was introduced into the deposition device according to the same procedure as introduction of $H_2$ gas. Then, by setting the mass flow controller 1133 so that the flow rate of $B_2H_6$ gas in bomb 1163 may be 1600 Vol. ppm relative to $SiH_4$ gas flow rate, $B_2H_6$ gas was introduced into the deposition device according to the same procedure as introduction of $H_2$ gas.

Next, by setting the mass flow controller 1134 so that the NO gas flow rate of 1164 may be 3.4 Vol. % relative to the $SiH_4$ gas flow rate, NO gas was introduced into the deposition device according to the same procedure as introduction of $H_2$ gas.

When the inner pressure in the deposition device was stabilized at 0.2 Torr, the high frequency power source 1101 was turned on and glow discharge was generated between the aluminum substrate 1105 and the cathode electrode 1108 by controlling the matching box, and an A—Si:H:B:O layer (p-type A—Si:H layer containing B and O) was deposited to a thickness of 5 μm at a high frequency power of 150 W (charge injection preventive layer). After deposition of a 5 μm thick A—Si:H:B layer (p-type), inflow of $B_2H_6$ was stopped by closing the valve 1123 without discontinuing discharging.

And, A—Si:H layer (non-doped) with a thickness of 20 μm was deposited at a high frequency power of 150 W (photosensitive layer). Then, with the high frequency power source and all the valves being closed, the deposition device was evacuated, the temperature of the aluminum substrate was lowered to room temperature and the substrate on which the light receiving layer was formed was taken out.

Separately, when a charge injection preventive layer and a photosensitive layer were formed on the same cylindrical aluminum substrate with the same surface characteristic under the same conditions and according to the same procedure as in the above case except for changing the high frequency power to 40 W, the surface of the photosensitive layer 1203 was found to be parallel to the surface of the substrate 1201, as shown in FIG. 12. The difference in the total layer thickness between the center and the both end portions of the aluminum substrate was 1 μm.

When the above high frequency power was made 160 W, the surface of the photosensitive layer 1303 and the surface of the substrate 1301 were unparallel to each other as shown in FIG. 13. In this case, the layer thickness difference in average layer thickness between the center and the both end portions was 2 μm.

For the two kinds of the light receiving members for electrophotography, image exposure was effected by means of the device shown in FIG. 14 with a semiconductor laser of a wavelength 780 nm with a spot size of 80 μm, followed by developing and transfer to obtain images. In the light receiving member with the surface characteristic as shown in FIG. 12 prepared at a high frequency power of 40 W, interference fringe pattern was observed.

On the other hand, in the light receiving member having the surface characteristic as shown in FIG. 13, no interference fringe pattern was observed and there could be obtained a member exhibiting practically satisfactory electrophotographic characteristics.

EXAMPLE 12

The surfaces of cylindrical aluminum substrates were worked by a lathe as shown in Table 1b. On these aluminum substrates (Cylinder Nos. 101b–108b) were prepared light receiving members for electrophotography under the same conditions as in Example 11 where no interference fringe pattern was observed (high frequency power 160 W) (Nos. 111b–118b). The difference in average layer thickness between the center and the both end portions of the aluminum substrate in the light receiving member for electrophotography was 2.2 μm.

The cross-sections of these light receiving members for electrophotography were observed by an electron microscope and the differences within the pitch of the photosensitive layer were measured to obtain the results as shown in Table 2b. For these light receiving members, image exposure was effected by means of the same device as shown in FIG. 14 similarly as in Example 11 using a semiconductor laser of wavelength 780 nm with a spot size of 80 μm to obtain the results as shown in Table 2b.

EXAMPLE 13

Light receiving members were prepared under the same conditions as in Example 12 except for the following points (Nos. 121b–128b). The charge injection preventive layer was made to have a thickness of 10 μm. The difference in average layer thickness between the center and the both ends of the charge injection preventive layer was 1.2 μm, with the average difference in thickness distribution between the center and the both ends of the photosensitive layer was 2.3 μm. When the thickness of each layer prepared on each substrate of Nos. 121b–128b was observed by an electron microscope, the results as shown in Table 3b were obtained. For these light receiving members, image exposure was conducted in the same image exposure device as in Example 11 to obtain the results as shown in Table 3b.

EXAMPLE 14

On cylindrical aluminum substrates (Nos. 101b–108b) having the surface characteristic as shown in Table 1b, light receiving members provided with the charge injection preventive layer containing nitrogen were prepared under the conditions as shown in Table 4b (Nos. 401b–408b).

The cross-sections of the light receiving members prepared under the above conditions were observed by an electron microscope. The average layer thickness of the charge injection preventive layer at the center and both ends of the cylinder was 0.09 μm. The average layer thickness of the photosensitive layer was 3 μm at the enter and both ends of the cylinder.

The layer thickness difference within the short range of the photosensitive layer of each light receiving member can be seen from the results shown in Table 5b.

When these light receiving members were subjected to image exposure with laser beam similarly as described in Example 11, the results as shown in Table 5b were obtained.

EXAMPLE 15

On cylindrical aluminum substrates (Nos. 101b–108b) having the surface characteristic as shown in Table 1b, light receiving members provided with the charge injection preventive layer containing nitrogen were prepared under the conditions as shown in Table 6b (Nos. 501b–508b).

The cross-sections of the light receiving members prepared under the above conditions were observed by an electron microscope. The average layer thickness of the charge injection preventive layer at the center and both ends of the cylinder was 0.3 μm. The average layer thickness of the photosensitive layer was 3.2 μm at the center and both ends of the cylinder.

The layer thickness difference within the short range of the photosensitive layer of each light receiving member can be seen from the results shown in Table 7b.

When these light receiving members were subjected to image exposure with laser beam similarly as described in Example 11, the results as shown in Table 7b were obtained.

EXAMPLE 16

On cylindrical aluminum substrates (Nos. 101b–108b) having the surface characteristic as shown in Table 1b, light receiving members provided with the charge injection preventive layer containing carbon were prepared under the conditions as shown in Table 8b (Nos. 901b–908b).

The cross-sections of the light receiving members prepared under the above conditions were observed by an electron microscope. The average layer thickness of the charge injection preventive layer at the center and both ends of the cylinder was 0.08 μm. The average layer thickness of the photosensitive layer was 2.5 μm at the center and both ends of the cylinder.

The layer thickness difference within the short range of the photosensitive layer of each light receiving member can be seen from the results shown in Table 9b.

When these light receiving members were subjected to image exposure with laser beam similarly as described in Example 11, the results as shown in Table 9b were obtained.

EXAMPLE 17

On cylindrical aluminum substrates (Nos. 101b–107b) having the surface characteristic as shown in Table 1b, light receiving members provided with the charge injection preventive layer containing carbon were prepared under the conditions as shown in Table 10b (Nos. 1101b–1108b).

The cross-sections of the light receiving members prepared under the above conditions were observed by an electron microscope. The average layer thickness of the charge injection preventive layer at the center and both ends of the cylinder was 1.1 μm. The average layer thickness of the light receiving layer was 3.4 μm at the center and both ends of the cylinder.

The layer thickness difference within the short range of the photosensitive layer of each light receiving member can be seen from the results shown in Table 11b.

When these light receiving members were subjected to image exposure with laser beam similarly as described in Example 11, the results as shown in Table 11b were obtained.

COMPARATIVE EXAMPLE 2

As a comparative test, an A—Si light receiving member for electrophotography was prepared according to entirely the same method as the light receiving member for electrophotography prepared at a high frequency power of 150 W in Example 11 except for employing an aluminum substrate whose surface had been roughened by the sand blast method in place of the aluminum substrate used in preparation of the light receiving member for electrophotography in Example 11. The surface condition of the aluminum substrate subjected to the surface roughening treatment by the sand blast method was subjected to measurement before provision of the light receiving layer by means of the universal surface shape measuring instrument (SE-3C) produced by Kosaka Research Institute to find that the average surface roughness was 1.8 μm.

The comparative light receiving member for electrophotography was mounted on the device shown in FIG. 14 as employed in Example 11 and similar measurement was conducted. As the result, clear interference fringe was found to be formed in the black image over the whole surface.

EXAMPLE 18

In this Example, a semiconductor laser (wavelength: 780 nm) with a spot size of 80 μm was employed. Thus, on a cylindrical aluminum substrate (length (L) 357 mm, outer diameter (r) 80 mm) on which A—Si:H is to be deposited, a spiral groove was prepared by a lathe with a pitch (P) of 25 μm and a depth (D) of 0.8 S. The form of the groove is shown in FIG. 10.

On this aluminum substrate, the charge injection preventive layer and the photosensitive layer were deposited by means of the device as shown in FIG. 11 in the following manner.

First, the constitution of the device is to be explained. 1101 is a high frequency power source, 1102 is a matching box, 1103 is a diffusion pump and a mechanical booster pump, 1104 is a motor for rotation of the aluminum substrate, 1105 is an aluminum substrate, 1106 is a heater for heating the aluminum substrate, 1107 is a gas inlet tube, 1108 is a cathode electrode for introduction of high frequency, 1109 is a shield plate, 1110 is a power source for heater, 1121 to 1125, 1141 to 1145 are valves, 1131 to 1135 are mass flow controllers, 1151 to 1155 are regulators, 1161 is a hydrogen ($H_2$) bomb, 1162 is a silane ($SiH_4$) bomb, 1163 is a diborane ($B_2H_6$) bomb, 1164 is a nitrogen monoxide (NO) bomb and 1167 is a methane ($CH_4$) bomb.

Next, the preparation procedure is to be explained. All of the main cocks of the bombs 1161–1165 were closed, all the mass flow controllers and the valves were opened and the deposition device was internally evacuated by the diffusion pump 1103 to $10^{-7}$ Torr. At the same time, the aluminum substrate 1105 was heated by the heater 1106 to 250° C. and maintained constantly at 250° C. After the temperature of the aluminum substrate 1105 became constantly at 250° C., the valves 1121–1125, 1141–1145 and 1151–1155 were closed, the main cocks of bombs 1161–1165 were opened and the diffusion pump 1103 was changed to the mechanical booster pump. The secondary pressure of the valves equipped with regulators 1151–1155 was set at 1.5 kg/cm$^2$. The mass flow controller 1131 was set at 300 SCCM, and the valves 1141 and 1121 were successively opened to introduce $H_2$ gas into the deposition device.

Next, by setting the mass flow controller 1132 at 150 SCCM, $SiH_4$ gas in bomb 1162 was introduced into the deposition device according to the same procedure as introduction of $H_2$ gas. Then, by setting the mass flow controller 1133 so that the flow rate of $B_2H_6$ gas in bomb 1163 may be 1600 Vol. ppm relative to $SiH_4$ gas flow rate, $B_2H_6$ gas was introduced into the deposition device according to the same procedure as introduction of $H_2$ gas.

Next, by setting the mass flow controller 1134 so that the initial value of the flow rate of the NO gas of 1164 may be 3.4 Vol. % relative to the $SiH_4$ gas flow rate, NO gas was introduced into the deposition device according to the same procedure as introduction of $H_2$ gas.

When the inner pressure in the deposition device was stabilized at 0.2 Torr, the high frequency power source 1101 was turned on and glow discharge was generated between the aluminum substrate 1105 and the cathode electrode 1108 by controlling the matching box 1102 and an A—Si:H:B:O layer (p-type A—Si:H layer containing B and O) was deposited to a thickness of 5 μm at a high frequency power of 160 W (charge injection preventive layer). During this operation, the NO gas flow rate was changed relative to the $SiH_4$ gas flow rate as shown in FIG. 21 so that the NO gas flow rate on completion of the layer formation became zero. After forming thus a A—Si:H:B:O (p-type) layer deposited to a thickness of 5 μm, the valves 1123 and 1124 were closed to terminate inflow of $B_2H_6$ and NO without discontinuing discharging.

And, A—Si:H layer (non-doped) with a thickness of 20 μm was deposited at a high frequency power of 160 W (photosensitive layer). Then, with the high frequency power source being turned off and with all the valves being closed, the deposition device was evacuated, the temperature of the aluminum substrate was lowered to room temperature and the substrate on which the light receiving layer was formed was taken out.

Separately, when a charge injection preventive layer and a photosensitive layer were formed on the same cylindrical aluminum substrate with the same surface characteristic under the same conditions and according to the same procedure as in the above case except for changing the high frequency power to 40 W, the surface of the photosensitive layer 1203 was found to be parallel to the surface of the substrate 1201, as shown in FIG. 12. The difference in the total layer thickness between the center and the both end portions of the aluminum substrate was 1 μm.

When the above high frequency power was made 160 W, the surface of the photosensitive layer 1303 and the surface of the substrate 1301 were unparallel to each other as shown in FIG. 13. In this case, the layer thickness difference in average layer thickness between the center and the both end portions was 2 μm.

For the two kinds of the light receiving members for electrophotography, image exposure was effected by means of the device shown in FIG. 14 with a semiconductor laser of a wavelength 780 nm with a spot size of 80 μm, followed by developing and transfer to obtain images. In the light receiving member with the surface characteristic as shown in FIG. 12 prepared at a high frequency power of 40 W, interference fringe pattern was observed.

On the other hand, in the light receiving member having the surface characteristic as shown in FIG. 13, no interference fringe pattern was observed and there could be obtained a member exhibiting practically satisfactory electrophotographic characteristics.

EXAMPLE 19

The surfaces of cylindrical aluminum substrates were worked by a lathe as shown in Table 1c. On these aluminum substrates (Cylinder Nos. 101c–108c) were prepared light receiving members for electrophotography under the same conditions as in Example 18 where no interference fringe pattern was observed (high frequency power 160 W) (Nos. 111c–118c). The difference in average layer thickness between the center and the both end portions of the aluminum substrate in the light receiving member for electrophotography was 2.2 μm.

The cross-sections of these light receiving members for electrophotography were observed by an electron microscope and the differences within the pitch of the photosensitive layer were measured to obtain the results as shown in Table 2c. For these photoreceptive members, image exposure was effected by means of the same device as shown in FIG. 14 similarly as in Example 18 using a semiconductor laser of wavelength 780 nm with a spot size of 80 μm to obtain the results as shown in Table 2c.

EXAMPLE 20

Light receiving members were prepared under the same conditions as in Example 19 except for the following points (Nos. 121c–128c). The charge injection preventive layer was made to have a thickness of 10 μm. The difference in average layer thickness between the center and the both ends of the charge injection preventive layer was 1.2 μm, with the average difference in thickness distribution between the center and the both ends of the photosensitive layer was 2.3 μm. When the thickness of each layer of No. 121C–128C was observed by an electron microscope, the results as shown in Table 3c were obtained. For these light receiving members, image exposure was conducted in the same image exposure device as in Example 18 to obtain the results as shown in Table 3c.

EXAMPLE 21

On cylindrical aluminum substrates (Nos. 101c–108c) having the surface characteristic as shown in Table 1c, light receiving members provided with the charge injection preventive layer containing nitrogen were prepared under the conditions as shown in Table 4c (Nos. 401c–408c).

The cross-sections of the light receiving members prepared under the above conditions were observed by an electron microscope. The average layer thickness of the charge injection preventive layer at the center and both ends of the cylinder was 0.09 μm. The average layer thickness of the photosensitive layer was 3 μm at the center and both ends of the cylinder.

The layer thickness difference within the short range of the photosensitive layer of each light receiving member (Sample Nos. 401c–408c) can be seen from the results shown in Table 5c.

When these light receiving members (Sample Nos. 401c–408c) were subjected to image exposure with laser beam similarly as described in Example 18, the results as shown in Table 5c were obtained.

EXAMPLE 22

On cylindrical aluminum substrates (Nos. 101c–108c) having the surface characteristic as shown in Table 1c, light receiving members provided with the charge injection preventive layer containing nitrogen were prepared under the conditions as shown in Table 6c (Nos. 501c–508c).

The cross-sections of the light receiving members prepared under the above conditions were observed by an electron microscope. The average layer thickness of the charge injection preventive layer at the center and both ends of the cylinder was 0.3 μm. The average layer thickness of the photosensitive layer was 3.2 μm at the center and both ends of the cylinder.

The layer thickness difference within the short range of the photosensitive layer of each light receiving member (Sample Nos. 501c–508c) can be seen from the results shown in Table 7c.

When these light receiving members (Sample Nos. 501c–508c) were subjected to image exposure with laser beam similarly as described in Example 18, the results as shown in Table 7c were obtained.

EXAMPLE 23

On cylindrical aluminum substrates (Nos. 101c–108c) having the surface characteristic as shown in Table 1c, light receiving members provided with the charge injection preventive layer containing carbon were prepared under the conditions as shown in Table 8c (No. 901c–908c).

The cross-sections of the light receiving members (Sample Nos. 901c–908c) prepared under the above conditions were observed by an electron microscope. The average layer thickness of the charge injection preventive layer at the center and both ends of the cylinder was 0.08 μm. The average layer thickness of the photosensitive layer was 2.5 μm at the enter and both ends of the cylinder.

The layer thickness difference within the short range of the photosensitive layer of each member (Sample Nos. 901c–908c) can be seen from the results shown in Table 9c.

When these light receiving members (Sample Nos. 901c–908c) were subjected to image exposure with laser beam similarly as described in Example 18, the results as shown in Table 9c were obtained.

EXAMPLE 24

On cylindrical aluminum substrates (Nos. 101c–108c) having the surface characteristic as shown in Table 1c, light receiving members provided with the charge injection preventive layer containing carbon were prepared under the conditions as shown in Table 10c (Nos. 1101c–1108c).

The cross-sections of the light receiving members prepared under the above conditions were observed by an electron microscope. The average layer thickness of the charge injection preventive layer at the center and both ends of the cylinder was 1.1 μm. The average layer thickness of the photosensitive layer was 3.4 μm at the center and both ends of the cylinder.

The layer thickness difference within the short range of the photosensitive layer of each light receiving member can be seen from the results shown in Table 11c.

When these light receiving members were subjected to image exposure with laser beam similarly as described in Example 18, the results as shown in Table 11c were obtained.

EXAMPLE 25

By means of the preparation device shown in FIG. 11, respective light receiving members for electrophotography (Sample Nos. 1201c–1204c) were prepared by carrying out layer formation on cylindrical aluminum substrates (Cylinder No. 105c) under the respective conditions as shown in Table 12c to Table 15c while changing the gas flow rate ratio of NO to $SiH_4$ according to the change rate curve of the gas flow rate ratio as shown in FIG. 25 to FIG. 28 with lapse of time for layer formation.

The thus prepared light receiving members were subjected to evaluation of characteristics, following the same conditions and the same procedure as in Example 18. As the result, in each sample, no interference fringe pattern was observed at all with naked eyes, and sufficiently good electrophotographic characteristics could be exhibited as suited for the object of the present invention.

EXAMPLE 26

Figure 25:
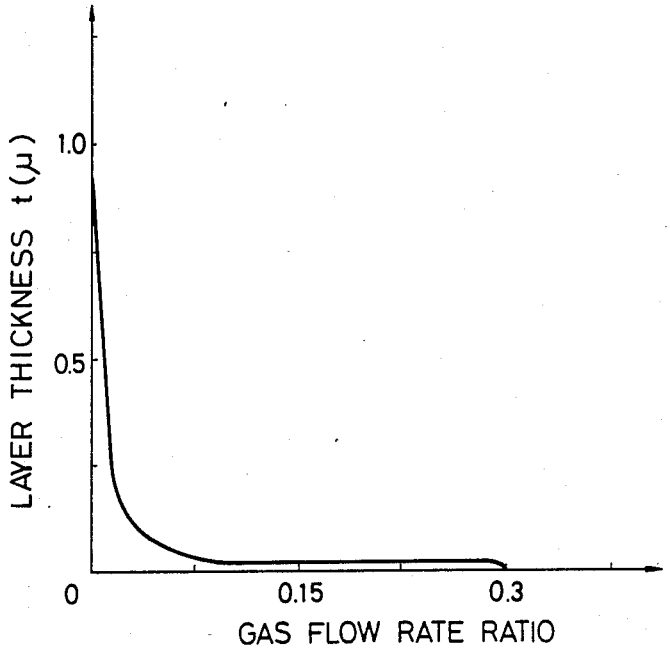
FIGS. 25 through 28 are each schematic illustration showing the change rate curve of the gas flow rate ratio.
Figure 26:
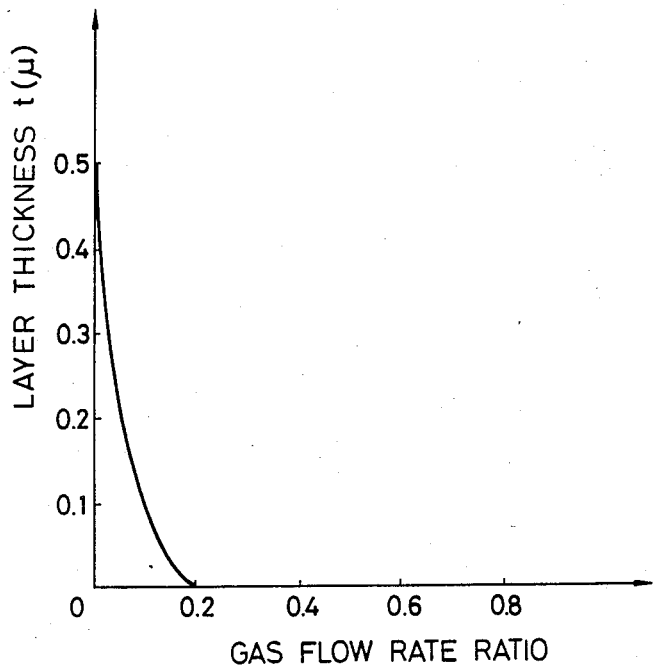
Figure 27:
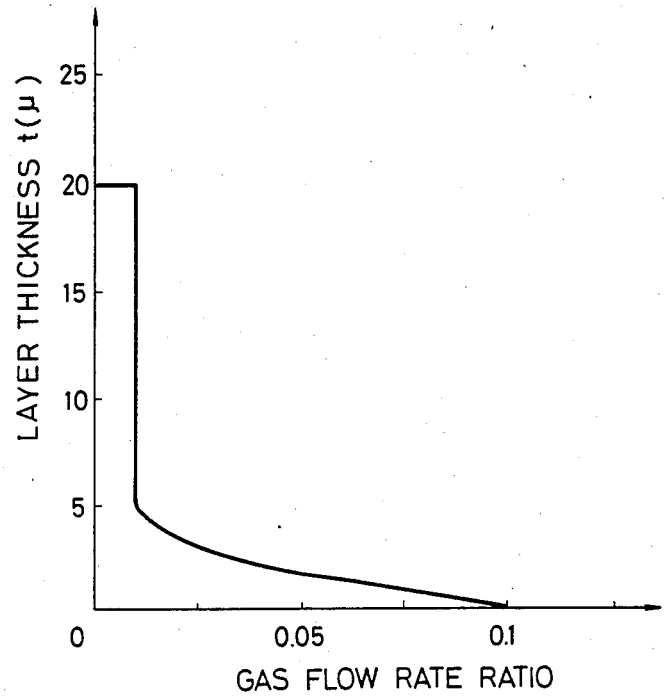
Figure 28:
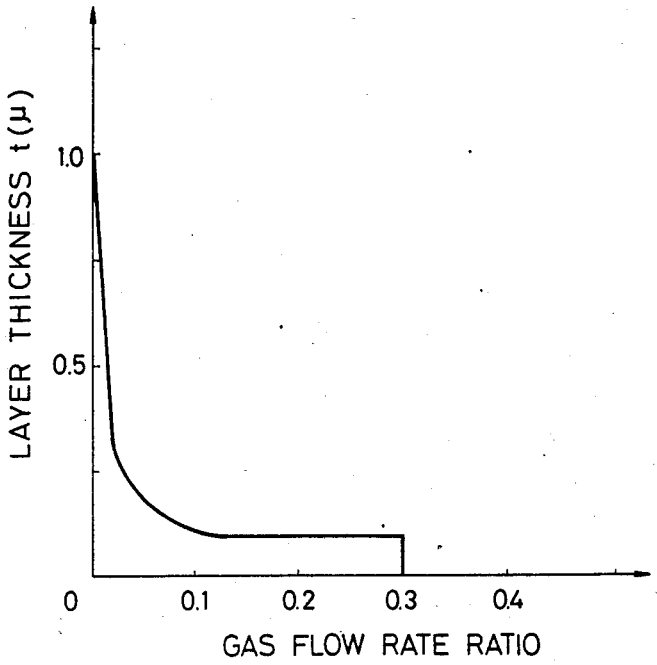

By means of the preparation device shown in FIG. 11, a light receiving member for electrophotography was prepared by carrying out layer formation on cylindrical aluminum substrates (Cylinder No. 105c) under the conditions as shown in Table 15c while changing the gas flow rate ratio of NO to $SiH_4$ according to the change rate curve of the gas flow rate ratio as shown in FIG. 25 with lapse of time for layer formation.

The thus prepared light receiving member were subjected to evaluation of characteristics, following the same conditions and the same procedure as in Example 18. As the result, no interference fringe pattern was observed at all with naked eyes, and sufficiently good electrophotographic characteristics could be exhibited as suited for the object of the present invention.

COMPARATIVE EXAMPLE 3

As a comparative test, an A—Si light receiving member for electrophotography was prepared according to entirely the same method as the light receiving member for electrophotography prepared at a high frequency power of 160 W in Example 18 except for employing an aluminum substrate whose surface had been roughened by the sand blast method in place of the aluminum substrate used in preparation of the light receiving member for electrophotography in Example 18. The surface condition of the aluminum substrate subjected to the surface roughening treatment by the sand blast method was subjected to measurement before provision of the light receiving layer by means of the universal surface shape measuring instrument (SE-3C) produced by Kosaka Research Institute to find that the average surface roughness was 1.8 μm.

The comparative light receiving member for electrophotography was mounted on the device shown in FIG. 14 as employed in Example 18 and similar measurement was conducted. As the result, clear interference fringe was found to be formed in the black image over the whole surface.

TABLE 1a

| | NO. | | | | | | | |
|---|---|---|---|---|---|---|---|---|
| | 101a | 102a | 103a | 104a | 105a | 106a | 107a | 108a |
| Pitch (μm) | 620 | 190 | 110 | 49 | 38 | 26 | 11 | 4.9 |

TABLE 1a-continued

| | NO. | | | | | | | |
|---|---|---|---|---|---|---|---|---|
| | 101a | 102a | 103a | 104a | 105a | 106a | 107a | 108a |
| Depth (μm) | 1.1 | 11 | 1.9 | 2.2 | 1.8 | 0.9 | 0.25 | 1.9 |
| Angle (degree) | 0.2 | 6.6 | 2.0 | 5.1 | 5.4 | 4.0 | 2.6 | 38 |

TABLE 2a

| | NO. | | | | | | | |
|---|---|---|---|---|---|---|---|---|
| | 111a | 112a | 113a | 114a | 115a | 116a | 117a | 118a |
| | Cylinder NO. | | | | | | | |
| | 101a | 102a | 103a | 104a | 105a | 106a | 107a | 108a |
| Difference in layer thickness (μm) | 0.04 | 0.06 | 0.14 | 0.15 | 0.3 | 0.2 | 0.11 | 2.8 |
| Interference fringe | X | X | ○ | ○ | ⊙ | ⊙ | Δ | X |

X Practically unusable
Δ Practically satisfactory
○ Practically very good
⊙ Practically excellent TABLE 3a

| | NO. | | | | | | | |
|---|---|---|---|---|---|---|---|---|
| | 121a | 122a | 123a | 124a | 125a | 126a | 127a | 128a |
| | Cylinder NO. | | | | | | | |
| | 101a | 102a | 103a | 104a | 105a | 106a | 107a | 108a |
| Difference in layer thickness of first layer (μm) | 0.05 | 0.05 | 0.06 | 0.18 | 0.31 | 0.22 | 0.71 | 2.4 |
| Difference in layer thickness of second layer (μm) | 0.06 | 0.06 | 0.1 | 0.2 | 0.35 | 0.32 | 0.31 | 3.2 |
| Interferance fringe | X | X | ○ | ⊙ | ⊙ | ⊙ | Δ | X |

X Practically unusable
Δ Practically satisfactory
○501 Practically very good
⊙ Practically excellent TABLE 4a

| | NO. | | | | | | |
|---|---|---|---|---|---|---|---|
| | 201a | 202a | 203a | 204a | 205a | 206a | 207a |
| Pitch (μm) | 41 | 32 | 26 | 21 | 11 | 4.9 | 2.1 |
| Depth (μm) | 3.51 | 2.6 | 0.9 | 1.1 | 0.71 | 0.11 | 0.51 |
| Angle (degree) | 9.7 | 9.2 | 4.0 | 6 | 7.4 | 2.6 | 26 |

TABLE 5a

| | NO. | | | | | | |
|---|---|---|---|---|---|---|---|
| | 211a | 212a | 213a | 214a | 215a | 216a | 217a |
| | Cylinder NO. | | | | | | |
| | 201a | 202a | 203a | 204a | 205a | 206a | 207a |
| Difference in layer thickness (μm) | 0.11 | 0.12 | 0.32 | 0.26 | 0.71 | 0.11 | 2.2 |
| Interference | Δ | ○ | ⊙ | ⊙ | ⊙ | Δ | X |

TABLE 5a-continued

| | NO. | | | | | | |
|---|---|---|---|---|---|---|---|
| | 211a | 212a | 213a | 214a | 215a | 216a | 217a |
| | Cylinder NO. | | | | | | |
| | 201a | 202a | 203a | 204a | 205a | 206a | 207a |
| fringe | | | | | | | |

TABLE 6a

| | NO. | | | | | | |
|---|---|---|---|---|---|---|---|
| | 221a | 222a | 223a | 224a | 225a | 226a | 227a |
| | Cylinder NO. | | | | | | |
| | 201a | 202a | 203a | 204a | 205a | 206a | 207a |
| Difference in layer thickness (μm) | 0.06 | 0.11 | 0.12 | 0.33 | 0.52 | 0.06 | 2.15 |
| Interference fringe | X | Δ | ○ | ○ | ⊙ | ⊙ | X | X |

X Practically unusable
Δ Practically satisfactory
○ Practically very good
⊙ Practically excellent TABLE 7a

| | NO. | | | | | | |
|---|---|---|---|---|---|---|---|
| | 231a | 232a | 233a | 234a | 235a | 236a | 237a |
| | Cylinder NO. | | | | | | |
| | 201a | 202a | 203a | 204a | 205a | 206a | 207a |
| Difference in layer thickness (μm) | 0.1 | 0.32 | 0.4 | 0.31 | 0.9 | 0.12 | 2.51 |
| Interference fringe | Δ | ⊙ | ⊙ | ⊙ | ⊙ | ○ | X |

X Practically unusable
Δ Practically satisfactory
○ Practically very good
⊙ Practically excellent TABLE 1b

| | NO. | | | | | | | |
|---|---|---|---|---|---|---|---|---|
| | 101b | 102b | 103b | 104b | 105b | 106b | 107b | 108b |
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 2b

| | NO. | | | | | | | |
|---|---|---|---|---|---|---|---|---|
| | 111b | 112b | 113b | 114b | 115b | 116b | 117b | 118b |
| | Cylinder NO. | | | | | | | |
| | 101b | 102b | 103b | 104b | 105b | 106b | 107b | 108b |
| Difference in layer thickness (μm) | 0.06 | 0.08 | 0.16 | 0.18 | 0.41 | 0.31 | 0.11 | 3.2 |
| Interference fringe | X | X | ○ | ○ | ⊙ | ⊙ | Δ | X |

X Practically unusable
Δ Practically satisfactory
○ Practically very good
⊙ Practically excellent TABLE 3b

| | NO. | | | | | | | |
|---|---|---|---|---|---|---|---|---|
| | 121b | 122b | 123b | 124b | 125b | 126b | 127b | 128b |
| | Cylinder NO. | | | | | | | |
| | 101b | 102b | 103b | 104b | 105b | 106b | 107b | 108b |
| Difference in layer thickness of first layer (μm) | 0.05 | 0.041 | 0.1 | 0.19 | 0.31 | 0.22 | 0.1 | 2.6 |
| Difference in layer thickness of second layer (μm) | 0.06 | 0.07 | 0.11 | 0.22 | 0.41 | 0.32 | 0.1 | 3.6 |
| Interference fringe | X | X | ○ | ⊙ | ⊙ | ⊙ | Δ | X |

X Practically unusable
Δ Practically satisfactory
○ Practically very good
⊙ Practically excellent TABLE 4b

| Name of layer | Starting gas | Flow rate (SCCM) | High frequency power (W) | Layer thickness (μm) |
|---|---|---|---|---|
| Charge injection preventive layer | $H_2$ | 300 | 160 | 3 |
| | $SiH_4$ | 150 | | |
| | $NH_3$ | 30 | | |
| | $B_2H_6$ | 0.24 | | |
| Photo-sensitive layer | $H_2$ | 300 | 300 | 20 |
| | $SiH_4$ | 300 | | |

TABLE 5b

| | NO. | | | | | | | |
|---|---|---|---|---|---|---|---|---|
| | 401b | 402b | 403b | 404b | 405b | 406b | 407b | 408b |
| | Cylinder NO. | | | | | | | |
| | 101b | 102b | 103b | 104b | 105b | 106b | 107b | 108b |
| Difference in layer thickness (μm) | 0.07 | 0.08 | 0.17 | 0.20 | 0.42 | 0.33 | 0.11 | 2.8 |
| Interference fringe | X | X | ○ | ⊙ | ⊙ | ⊙ | Δ | X |

X Practically unusable
Δ Practically satisfactory
○ Practically very good
⊙ Practically excellent TABLE 6b

| Name of layer | Starting gas | Flow rate (SCCM) | High frequency power (W) | Layer thickness (μm) |
|---|---|---|---|---|
| Charge injection preventive layer | $H_2$ | 300 | 160 | 5 |
| | $SiH_4$ | 150 | | |
| | $NH_3$ | 15 | | |
| | $B_2H_6$ | 0.3 | | |
| Photo-sensitive layer | $H_2$ | 300 | 200 | 20 |
| | $SiH_4$ | 300 | | |

TABLE 7b

| | NO. | | | | | | | |
|---|---|---|---|---|---|---|---|---|
| | 501b | 502b | 503b | 504b | 505b | 506b | 507b | 508b |
| | Cylinder NO. | | | | | | | |
| | 101b | 102b | 103b | 104b | 105b | 106b | 107b | 108b |
| Difference in layer | 0.05 | 0.07 | 0.1 | 0.21 | 0.31 | 0.22 | 0.1 | 2.6 |

TABLE 7b-continued

| | NO. | | | | | | | |
|---|---|---|---|---|---|---|---|---|
| | 501b | 502b | 503b | 504b | 505b | 506b | 507b | 508b |
| | Cylinder NO. | | | | | | | |
| | 101b | 102b | 103b | 104b | 105b | 106b | 107b | 108b |
| thickness of first layer (μm) | | | | | | | | |
| Difference in layer thickness of second layer (μm) | 0.06 | 0.08 | 0.1 | 0.2 | 0.41 | 0.35 | 0.1 | 3.5 |
| Interference fringe | X | X | ○ | ◎ | ◎ | ◎ | Δ | X |

X Practically unusable
Δ Practically satisfactory
○ Practically very good
◎ Practically excellent TABLE 8b

| Name of layer | Starting gas | Flow rate (SCCM) | High frequency power (W) | Layer thickness (μm) |
|---|---|---|---|---|
| Charge injection preventive layer | $H_2$ | 300 | 170 | 2.8 |
| | $SiH_4$ | 150 | | |
| | $CH_4$ | 15 | | |
| | $B_2H_6$ | 0.45 | | |
| Photo-sensitive layer | $H_2$ | 300 | 200 | 21 |
| | $SiH_4$ | 300 | | |

TABLE 9b

| | NO. | | | | | | | |
|---|---|---|---|---|---|---|---|---|
| | 901b | 902b | 903b | 904b | 905b | 906b | 907b | 908b |
| | Cylinder NO. | | | | | | | |
| | 101b | 102b | 103b | 104b | 105b | 106b | 107b | 108b |
| Difference in layer thickness (μm) | 0.07 | 0.09 | 0.16 | 0.19 | 0.46 | 0.35 | 0.1 | 3.2 |
| Interference fringe | X | X | ○ | ○ | ◎ | ◎ | Δ | X |

X Practically unusable
Δ Practically satisfactory
○ Practically very good
◎ Practically excellent TABLE 10b

| Name of layer | Starting gas | Flow rate (SCCM) | High frequency power (W) | Layer thickness (μm) |
|---|---|---|---|---|
| Charge injection preventive layer | $H_2$ | 300 | 170 | 5.1 |
| | $SiH_4$ | 160 | | |
| | $CH_4$ | 16 | | |
| | $B_2H_6$ | 0.4 | | |
| Photo-sensitive layer | $H_2$ | 300 | 230 | 22 |
| | $SiH_4$ | 300 | | |

TABLE 11b

| | NO. | | | | | | | |
|---|---|---|---|---|---|---|---|---|
| | 1101b | 1102b | 1103b | 1104b | 1105b | 1106b | 1107b | 1108b |
| | Cylinder NO. | | | | | | | |
| | 101b | 102b | 103b | 104b | 105b | 106b | 107b | 108b |
| Difference in layer thickness of first layer (μm) | 0.05 | 0.06 | 0.1 | 0.22 | 0.31 | 0.21 | 0.1 | 2.7 |
| Difference in layer thickness of second layer (μm) | 0.07 | 0.08 | 0.11 | 0.35 | 0.45 | 0.31 | 0.1 | 3.5 |
| Interference fringe | X | X | ○ | ◎ | ◎ | ◎ | Δ | X |

X Practically unusable
Δ Practically satisfactory
○ Practically very good
◎ Practically excellent TABLE 1c

| | NO. | | | | | | | |
|---|---|---|---|---|---|---|---|---|
| | 101c | 102c | 103c | 104c | 105c | 106c | 107c | 108c |
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 2c

| | NO. | | | | | | | |
|---|---|---|---|---|---|---|---|---|
| | 111c | 112c | 113c | 114c | 115c | 116c | 117c | 118c |
| | Cylinder NO. | | | | | | | |
| | 101c | 102c | 103c | 104c | 105c | 106c | 107c | 108c |
| Difference in layer thickness (μm) | 0.06 | 0.08 | 0.16 | 0.18 | 0.41 | 0.31 | 0.11 | 3.2 |
| Interference fringe and electro-photographic characteristics | X | X | ○ | ○ | ◎ | ◎ | Δ | X |

X Practically unusable
Δ Practically satisfactory
○ Practically very good
◎ Practically excellent TABLE 3c

| | NO. | | | | | | | |
|---|---|---|---|---|---|---|---|---|
| | 121c | 122c | 123c | 124c | 125c | 126c | 127c | 128c |
| | Cylinder NO. | | | | | | | |
| | 101c | 102c | 103c | 104c | 105c | 106c | 107c | 108c |
| Difference in layer thickness of first layer (μm) | 0.05 | 0.041 | 0.1 | 0.19 | 0.31 | 0.22 | 0.1 | 2.6 |
| Difference in layer thickness of second layer (μm) | 0.06 | 0.07 | 0.11 | 0.22 | 0.41 | 0.32 | 0.1 | 3.6 |
| Interference fringe and electro-photographic characteristics | X | X | ○ | ⊙ | ⊙ | ⊙ | Δ | X |

X Practically unusable
Δ Practically satisfactory
○ Practically very good
⊙ Practically excellent TABLE 4c

| Name of layer | Starting gas | Flow rate (SCCM) | High frequency power (W) | Layer thickness (μm) |
|---|---|---|---|---|
| Charge injection preventive layer | $H_2$ | 300 | 160 | 3 |
| | $SiH_4$ | 150 | | |
| | $NH_3$ | 30 | | |
| | $B_2H_6$ | 0.24 | | |
| Photo-sensitive layer | $H_2$ | 300 | 300 | 20 |
| | $SiH_4$ | 300 | | |

TABLE 5c

| | NO. | | | | | | | |
|---|---|---|---|---|---|---|---|---|
| | 401c | 402c | 403c | 404c | 405c | 406c | 407c | 408c |
| | Cylinder NO. | | | | | | | |
| | 101c | 102c | 103c | 104c | 105c | 106c | 107c | 108c |
| Difference in layer thickness (μm) | 0.07 | 0.08 | 0.17 | 0.20 | 0.42 | 0.33 | 0.11 | 2.8 |
| Interference fringe and electro-photographic characteristics | X | X | ○ | ⊙ | ⊙ | ⊙ | Δ | X |

X Practically unusable
Δ Practically satisfactory
○ Practically very good
⊙ Practically excellent TABLE 6c

| Name of layer | Starting gas | Flow rate (SCCM) | High frequency power (W) | Layer thickness (μm) |
|---|---|---|---|---|
| Charge injection preventive layer | $H_2$ | 300 | 160 | 5 |
| | $SiH_4$ | 150 | | |
| | $NH_3$ | 15 | | |
| | $B_2H_6$ | 0.3 | | |
| Photo-sensitive layer | $H_2$ | 300 | 200 | 20 |
| | $SiH_4$ | 300 | | |

TABLE 7c

| | NO. | | | | | | | |
|---|---|---|---|---|---|---|---|---|
| | 501c | 502c | 503c | 504c | 505c | 506c | 507c | 508c |
| | Cylinder NO. | | | | | | | |
| | 101c | 102c | 103c | 104c | 105c | 106c | 107c | 108c |
| Difference in layer thickness of first layer (μm) | 0.05 | 0.07 | 0.1 | 0.21 | 0.31 | 0.22 | 0.1 | 2.6 |
| Difference in layer thickness of second layer (μm) | 0.06 | 0.08 | 0.1 | 0.2 | 0.41 | 0.35 | 0.1 | 3.5 |
| Interference fringe and electro-photographic characteristics | X | X | ○ | ⊙ | ⊙ | ⊙ | Δ | X |

X Practically unusabe
Δ Practically satisfactory
○ Practically very good
⊙ Practically excellent TABLE 8c

| Name of layer | Starting gas | Flow rate (SCCM) | High frequency power (W) | Layer thickness (μm) |
|---|---|---|---|---|
| Charge injection preventive layer | $H_2$ | 300 | 170 | 2.8 |
| | $SiH_4$ | 150 | | |
| | $CH_4$ | 15 | | |
| | $B_2H_6$ | 0.45 | | |
| Photo-sensitive layer | $H_2$ | 300 | 200 | 21 |
| | $SiH_4$ | 300 | | |

TABLE 9c

| | NO. | | | | | | | |
|---|---|---|---|---|---|---|---|---|
| | 901c | 902c | 903c | 904c | 905c | 906c | 907c | 908c |
| | Cylinder NO. | | | | | | | |
| | 101c | 102c | 103c | 104c | 105c | 106c | 107c | 108c |
| Difference in layer thickness (μm) | 0.07 | 0.09 | 0.16 | 0.19 | 0.46 | 0.35 | 0.1 | 3.2 |
| Interference fringe and electro-photographic characteristics | X | X | ○ | ○ | ⊙ | ⊙ | Δ | X |

X Practically unusable
Δ Practically satisfactory
○ Practically very good
⊙ Practically excellent TABLE 10c

| Name of layer | Starting gas | Flow rate (SCCM) | High frequency power (W) | Layer thickness (μm) |
|---|---|---|---|---|
| Charge injection preventive layer | $H_2$ | 300 | 170 | 5.1 |
| | $SiH_4$ | 160 | | |
| | $CH_4$ | 16 | | |
| | $B_2H_6$ | 0.4 | | |
| Photo-sensitive layer | $H_2$ | 300 | 230 | 22 |
| | $SiH_4$ | 300 | | |

TABLE 11c

| | NO. | | | | | | | |
|---|---|---|---|---|---|---|---|---|
| | 1101c | 1102c | 1103c | 1104c | 1105c | 1106c | 1107c | 1108c |
| | Cylinder NO. | | | | | | | |
| | 101c | 102c | 103c | 104c | 105c | 106c | 107c | 108c |
| Difference in layer thickness of first layer (μm) | 0.05 | 0.06 | 0.1 | 0.22 | 0.31 | 0.21 | 0.1 | 2.7 |
| Difference in layer thickness of second layer (μm) | 0.07 | 0.08 | 0.11 | 0.35 | 0.45 | 0.31 | 0.1 | 3.5 |
| Interference fringe and electro-photographic character-istics | X | X | ○ | ⊙ | ⊙ | ⊙ | Δ | X |

X Practically unusable
Δ Practically satisfactor
○ Practically very good
⊙ Practically excellent

TABLE 12C (Sample No. 1201)

| Layer consti-tution | Gases employed | Flow rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>NO | $SiH_4 = 50$ | $NO/SiH_4 = 3/10 \sim 0$ | 150 | 12 | 1 |
| Second layer | $SiH_4/He = 0.05$ | $SiH_4 = 50$ | | 150 | 12 | 20 |

TABLE 13C (Sample No. 1202)

| Layer consti-tution | Gases employed | Flow rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>$B_2H_6/He = 10^{-3}$<br>NO | $SiH_4 = 50$ | $B_2H_6/SiH_4 = 4 \times 10^{-3}$<br>$NO/SiH_4 = 2/10 \sim 0$ | 150 | 12 | 0.5 |
| Second layer | $SiH_4/He = 0.05$ | $SiH_4 = 50$ | | 150 | 12 | 20 |

TABLE 14C (Sample No. 1203)

| Layer consti-tution | Gases employed | Flow rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>$B_2H_6/He = 10^{-3}$<br>NO | $SiH_4 = 50$ | $B_2H_6/SiH_4 = 2 \times 10^{-4}$<br>$NO/SiH_4 = 1/10 \sim 1/100$ | 160 | 14 | 5 |
| Second layer | $SiH_4/He = 0.05$<br>NO | $SiH_4 = 50$ | $NO/SiH_4 = 1/100$ | 160 | 14 | 15 |

TABLE 15C (Sample No. 1204)

| Layer consti-tution | Gases employed | Flow rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>$B_2H_6/He = 10^{-3}$<br>NO | $SiH_4 = 50$ | $B_2H_6/SiH_4 = 2 \times 10^{-4}$<br>$NO/SiH_4 = 3/10 \sim 0$ | 160 | 14 | 1.0 |
| Second | $SiH_4/He = 0.05$ | $SiH_4 = 50$ | $B_2H_6/SiH_4 = 2 \times 10^{-4}$ | 160 | 12 | 15 |

TABLE 15C-continued

| Layer constitution | Gases employed | Flow rate (SCCM) | Flow rate ratio | Discharging power (W) | (Sample No. 1204) Layer formation rate (Å/sec) | Layer thickness (μ) |
|---|---|---|---|---|---|---|
| layer | $B_2H_6/He = 10^{-3}$ | | | | | |

TABLE 16c

| Layer constitution | Gases employed | Flow rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>$PH_3/He = 10^{-3}$<br>NO | $SiH_4 = 50$ | $PH_3/SiH_4 = 3 \times 10^{-4}$<br>$NO/SiH_4 = 3/10 \sim 0$ | 170 | 15 | 1 |
| Second layer | $SiH_4/He = 0.05$ | $SiH_4 = 50$ | | 170 | 15 | 20 |

We claim:

1. A light-receiving member comprising a light-receiving layer of a multi-layer structure having at least one photosensitive layer on a substrate, said light-receiving layer having at least one pair of non-parallel interfaces within a short range and said non-parallel interfaces being arranged in a large number in at least one direction within the plane perpendicular to the layer thickess direction, each of said non-parallel interfaces being smoothly continuous in the direction in which they are arranged and wherein said at least one pair of non-parallel interfaces has a cycle length (l)≦ the spot size of incident light and the difference in thickness of the layer between the non-parallel interfaces at said cycle l, is $\geqq \lambda/2_n$ wherein λ is the wavelength of said incident light and n is the refractive index of said layer, whereby the tendency of said layer to form interference fringes is suppressed since the direction of said incident light reflected from one of said interfaces of said light-receiving layer is different from the direction of light emitted by the reflection of said incident light from the other of said interfaces.

2. A light-receiving member according to claim 1, wherein the arrangement is made regularly.

3. A light-receiving member according to claim 1, wherein the arrangement is made in cycles.

4. A light-receiving member according to claim 1, wherein the short range is 0.3 to 500μ.

5. A light-receiving member according to claim 1, wherein the non-parallel interfaces are formed on the basis of the smooth unevenness arranged regularly provided on the surface of said substrate.

6. A light-receiving member according to claim 5, wherein the said unevenness is formed by the projections of sine wave shape.

7. A light-receiving member according to claim 1, wherein the substrate is cylindrical.

8. A light-receiving member according to claim 7, wherein the projection of the sine wave shape has a spiral structure within the plane of said substrate.

9. A light-receiving member according to claim 8, wherein the spiral structure is a multiple spiral structure.

10. A light-receiving member according to claim 6, wherein the projection of sine wave shape is divided in its edge line direction.

11. A light-receiving member according to claim 7, wherein the edge line direction of the projection of the sine wave shape is along the center axis of the cylindrical substrate.

12. A light-receiving member according to claim 5, wherein the smooth enevenness has inclined planes.

13. A light-receiving member according to claim 12, wherein the inclined planes are mirror finished.

14. A light-receiving member according to claim 5, wherein on the free surface of the light-receiving layer is formed a smooth unevenness arranged with the same pitch as that of the smooth unevenness provided on the substrate surface.

15. A light-receiving member according to claim 1, wherein the photosensitive layer comprises an amorphous material containing silicon atoms.

16. A light-receiving member according to claim 15, wherein hydrogen atoms are contained in the photosensitive layer.

17. A light-receiving member according to claim 5, wherein the pitch of the recessed portions of the smooth unevenness is 0.3 μm to 500 μm.

18. A light-receiving member according to claim 5, wherein the maximum depth of the recessed portions of the unevenness is 0.1 μm to 5 μm.

19. A light-receiving member according to claim 1, wherein the light-receiving layer has a charge injection preventive layer as its constituent layer on the substrate side.

20. A light-receiving member according to claim 19, wherein a substance (C) for controlling conductivity is contained in the charge injection preventive layer.

21. A light-receiving member according to claim 20, wherein the content of the substance (C) for controlling conductivity in the charge injection preventive layer is 0.001 to $5 \times 10^4$ atomic ppm.

22. A light-receiving member according to claim 19, wherein the charge injection preventive layer has a thickness of 30 Å to 10μ.

23. A light-receiving member according to claim 1, wherein the photosensitive layer has a thickness of 1 to 100 μm.

24. A light-receiving member according to claim 1, wherein a substance for controlling conductivity is contained in the photosensitive layer.

25. A light-receiving member according to claim 24, wherein the content of the substance for controlling conductivity in the photosensitive layer is 0.001 to 1000 atomic ppm.

26. A light-receiving member according to claim 15, wherein hydrogen atoms are contained in the photosensitive layer.

27. A light-receiving member according to claim 26, wherein the content of hydrogen atoms in the photosensitive layer is 1 to 40 atomic %.

28. A light-receiving member according to claim 15, wherein halogen atoms are contained in the photosensitive layer.

29. A light-receiving member according to claim 28, wherein the content of halogen atoms in the photosensitive layer is 1 to 40 atomic %.

30. A light-receiving member according to claim 15, wherein hydrogen atoms and halogen atoms are contained in the photosensitive layer.

31. A light-receiving member according to claim 30, wherein the sum of the contents of hydrogen atoms and halogen atoms in the photosensitive layer is 1 to 40 atomic %.

32. A light-receiving member according to claim 1, wherein the light-receiving layer has a barrier layer comprising an electrically insulating material on the substrate side as its constituent layer.

33. A light-receiving member according to claim 32, wherein the electrically insulating material is selected from $Al_2O_3$, $SiO_2$, $Si_3N_4$ and polycarbonate.

34. A light-receiving member according to claim 15, wherein the light-receiving layer contains at least one kind of atoms selected from oxygen atoms, carbon atoms and nitrogen atoms.

35. A light-receiving member according to claim 15, wherein the light-receiving layer has a layer region (OCN) containing at least one kind of atoms (OCN) selected from oxygen atoms, carbon atoms and nitrogen atoms.

36. A light-receiving member according to claim 35, wherein the distribution concentration C (OCN) of the atoms (OCN) contained in the layer region (OCN) is uniform in the layer thickness direction.

37. A light-receiving member according to claim 35, wherein the distribution concentration C (OCN) of the atoms (OCN) contained in the layer region (OCN) is ununiform in the layer thickness direction.

38. A light-receiving member according to claim 35, wherein the layer region (OCN) is provided at the end portion on the substrate side of the light-receiving layer.

39. A light-receiving member according to claim 35, wherein the content of the atoms (OCN) in the layer region (OCN) is 0.001 to 50 atomic %.

40. A light-receiving member according to claim 35, wherein the proportion of the layer thickness of the layer region (OCN) occupied in the light-receiving layer is 2/5 or higher and the content of the atoms (OCN) in the layer region (OCN) is 30 atomic % or less.

41. A light-receiving member according to claim 37, wherein said ununiform distributed state has a portion in which the depth profile is decreased toward the side of the free surface of said light-receiving layer.

42. A light-receiving member according to claim 37, wherein said ununiform distributed state has a portion in which the depth profile is increased toward the side of said substrate.

43. A light-receiving member according to claim 37, wherein said ununiform distributed state has the maximum distribution concentration in the end portion layer region on the substrate side of said light-receiving layer.

44. A light-receiving member according to claim 37, wherein said ununiform distributed state forms a moderate change in refractive index.

45. A light-receiving member according to claim 1, wherein the light-receiving layer has a barrier layer, a charge generation layer and a charge transport layer.

46. An electrophotographic image forming process comprising:

(a) applying a charging treatment to the light receiving member of claim 1;

(b) irradiating the light receiving member with a laser beam carrying information to form an electrostatic latent image; and (c) developing the electrostatic latent image.

* * * * *

UNITED STATES PATENT AND TRADEMARK OFFICE

CERTIFICATE OF CORRECTION

PATENT NO. : 4,696,884

DATED : September 29, 1987

INVENTOR(S) : KEISHI SAITOH, ET AL.

It is certified that error appears in the above-identified patent and that said Letters Patent is hereby corrected as shown below:

COLUMN 1

Line 12, "partains" should read --pertains--.
Line 34, "86341/979" should read --86341/1979--.

COLUMN 2

Lines 18-19, "so called" should read --so-called--.
Line 20, "a cause" should read --causes--.

COLUMN 3

Lines 13-14, "so called" should read --so-called--.
Line 22, "degrassihg" should read --degassing--.
Line 67, "so much" should read --greatly--.

COLUMN 4

Line 59, "of" should be deleted.

COLUMN 5

Line 21, "is a schematic illustration" should read --are schematic illustrations--.
Line 25, "is a schematic illustration" should read --are schematic illustrations--.
Line 30,"intefernece" should read --interference--.
Line 56, "is a schematic illustration" should read --are schematic illustrations--.

UNITED STATES PATENT AND TRADEMARK OFFICE

CERTIFICATE OF CORRECTION

PATENT NO. : 4,696,884

DATED : September 29, 1987

INVENTOR(S) : KEISHI SAITOH, ET AL.

It is certified that error appears in the above-identified patent and that said Letters Patent is hereby corrected as shown below:

COLUMN 6

Line 2, "munite" should read --minute--.
Line 44, "resolving" should read --the resolving--.
Line 51, "1<L," should read --1≪L--.

COLUMN 9

Line 13, "so called" should read --so-called--.
Line 30, "be suitably be" should read --suitably be--.
Line 63, "ihibited" should read --inhibited--.

COLUMN 10

Lines 40-41, "so called" should read --so-called--.

COLUMN 13

Line 12, "$t_T$" should read --$t_6$--.

COLUMN 15

Line 2, "compoudns" should read --compounds--.
Line 5, "so called" should read --so-called--.

COLUMN 16

Line 1, "the an" should read --an--.
Lines 7-8, "introducion" should read --introduction--.
Line 56, "ammonius" should read --ammonium--.

UNITED STATES PATENT AND TRADEMARK OFFICE

CERTIFICATE OF CORRECTION

PATENT NO. : 4,696,884

DATED : September 29, 1987

INVENTOR(S) : KEISHI SAITOH, ET AL.

It is certified that error appears in the above-identified patent and that said Letters Patent is hereby corrected as shown below:

COLUMN 17

Line 13, "gradaully" should read --gradually--.

COLUMN 18

Line 21, "varrier" should read --barrier--.
Line 27, "0.5μto" should read --0.5 μ to--.
Line 34, "indico" should read --indigo--.
Line 58, "styreneacrylonitrile" should read --styrene-acrylonitrile--.

COLUMN 19

Line 4, "us" should read --is--.
Line 61, "may be" should read --was--.

COLUMN 20

Line 55, "-118a." should read ---118a).--

COLUMN 21

Line 5, "(No. 121a-128a." should read --(Nos. 121a-128a).--
Line 11, "was" should read --of--.
Line 36, "memgers" should read --members--.

UNITED STATES PATENT AND TRADEMARK OFFICE

CERTIFICATE OF CORRECTION

PATENT NO. : 4,696,884

DATED : September 29, 1987

INVENTOR(S) : KEISHI SAITOH, ET AL.

It is certified that error appears in the above-identified patent and that said Letters Patent is hereby corrected as shown below:

COLUMN 23

Lines 5-6, "in terms of solid matters" should read --by weight of solids--.
Line 50, "is" should read --in--.

COLUMN 24

Line 23, "An" should read --A--.
Line 58, "aluminum" should read --aluminum substrate--.
Line 60, "aluminum" should read --aluminum substrate--.
Line 68, delete "reflective".

COLUMN 26

Line 3, "constantly" should read --constant--.
Line 5, "constantly" should read --constant--.
Line 20, "may be" should read --was--.
Line 25, "of 1164 may be" should read --in bomb 1164 was--.

COLUMN 27

Line 65, "enter" should read --center--.

COLUMN 29

Line 60, "constantly" should read --constant--.
Line 62, "constantly" should read --constant--.

UNITED STATES PATENT AND TRADEMARK OFFICE

CERTIFICATE OF CORRECTION

PATENT NO. : 4,696,884

DATED : September 29, 1987

INVENTOR(S) : KEISHI SAITOH, ET AL.

It is certified that error appears in the above-identified patent and that said Letters Patent is hereby corrected as shown below:

COLUMN 30

Line 8, "may be" should read --was--.
Lines 13-14, "of 1164 may be" should read --in bomb 1164 was--.

COLUMN 31

Line 38, "was" should read --of--.

COLUMN 32

Line 38, "enter" should read --center--.

COLUMN 33

Line 33, "were" should read --was--.

COLUMN 34

Line 45, "○ 501 Practically very good" should read --○ Practically very good--.

COLUMN 35

Line 20, "X △ ○ ○ ◎ ● X X" should read --X △ ○ ◎ ◎ X X--.

COLUMN 40

Line 22, "unusabe" should read --unusable--.

UNITED STATES PATENT AND TRADEMARK OFFICE

CERTIFICATE OF CORRECTION

PATENT NO. : 4,696,884

DATED : September 29, 1987

INVENTOR(S) : KEISHI SAITOH, ET AL.

It is certified that error appears in the above-identified patent and that said Letters Patent is hereby corrected as shown below:

COLUMN 41

Line 22, "satisfactor" should read --satisfactory--.

COLUMN 43

Line 58, "claim 7," should read --claim 6,--.

Signed and Sealed this

Tenth Day of May, 1988

*Attest:*

*Attesting Officer*

DONALD J. QUIGG

*Commissioner of Patents and Trademarks*